US012409961B2

(12) United States Patent
Skerlong et al.

(10) Patent No.: US 12,409,961 B2
(45) Date of Patent: Sep. 9, 2025

(54) TRAY INSERTION SYSTEM AND METHOD

(71) Applicant: Van Doren Sales, Inc., East Wenatchee, WA (US)

(72) Inventors: Jason Skerlong, Wenatchee, WA (US); Luke Divis, Brewster, WA (US); Adam Goff, Wenatchee, WA (US); Scott Wilson, Wenatchee, WA (US); John Sheehan, Yakima, WA (US); Joshua Silver, Wenatchee, WA (US); Lance Webb, East Wenatchee, WA (US)

(73) Assignee: Van Doren Sales, Inc., East Wenatchee, WA (US)

( * ) Notice: Subject to any disclaimer, the term of this patent is extended or adjusted under 35 U.S.C. 154(b) by 0 days.

(21) Appl. No.: 18/504,145

(22) Filed: Nov. 7, 2023

(65) Prior Publication Data

US 2024/0150049 A1 May 9, 2024

Related U.S. Application Data

(60) Provisional application No. 63/382,958, filed on Nov. 9, 2022.

(51) Int. Cl.
*B65B 57/20* (2006.01)
*B65B 5/06* (2006.01)
(Continued)

(52) U.S. Cl.
CPC ..... *B65B 5/068* (2013.01); *B65B 5/108* (2013.01); *B65B 57/20* (2013.01); *B65B 25/046* (2013.01)

(58) Field of Classification Search
USPC ..... 53/443
See application file for complete search history.

(56) References Cited

U.S. PATENT DOCUMENTS 4,294,061 A 10/1981 Lekas
4,355,936 A * 10/1982 Thomas ..... B65G 47/91 414/797
(Continued)

FOREIGN PATENT DOCUMENTS

CN 107792588 B 4/2021
FR 2983458 A1 6/2013
(Continued)

OTHER PUBLICATIONS

An International Search Report and Written Opinion mailed by the International Searching Authority on Apr. 9, 2024 in connection with PCT/US2023/79016.

*Primary Examiner* — Chinyere J Rushing-Tucker
(74) *Attorney, Agent, or Firm* — LeFevour Law, LLC; Martin LeFevour

(57) ABSTRACT

An apparatus for packing a plurality of filled produce trays into a transport container, such as a box or a carton, without bruising the produce in the process. The produce packing system includes an infeed belt, produce information sensors and a processing assembly. The processing assembly receives information from the produce information sensors to calculate a container packing position. Using this information, the produce packing system clamps onto a filled produce tray from an infeed belt and moves the filled produce tray downward into a transport container at a predetermined height to place the filled produce tray into the transport container.

20 Claims, 25 Drawing Sheets

(51) Int. Cl.
*B65B 5/10* (2006.01)
*B65B 25/04* (2006.01)

(56) References Cited

U.S. PATENT DOCUMENTS

| | | | | |
|---|---|---|---|---|
| 6,056,341 | A * | 5/2000 | Bliss | B65G 47/90 294/198 |
| 6,606,841 | B1 * | 8/2003 | Germunson | H05K 13/021 901/30 |
| 7,096,650 | B2 | 8/2006 | Van Dam | |
| 8,172,292 | B1 * | 5/2012 | Andersen | B65B 25/046 294/2 |
| 8,565,912 | B2 | 10/2013 | Wappling et al. | |
| 9,156,570 | B2 | 10/2015 | Lomerson | |
| 9,248,926 | B2 | 2/2016 | Davidson et al. | |
| 10,906,069 | B2 | 2/2021 | Nijland et al. | |
| 11,034,034 | B2 | 6/2021 | Scarfe et al. | |
| 11,458,633 | B2 | 10/2022 | Ukisu et al. | |
| 2004/0182682 | A1 | 9/2004 | Chadwick | |
| 2005/0178090 | A1 | 8/2005 | Koke et al. | |
| 2006/0207219 | A1 * | 9/2006 | Sandberg | B65B 25/06 53/252 |
| 2008/0000203 | A1 | 1/2008 | Gilmore et al. | |
| 2012/0047851 | A1 | 3/2012 | Germunson | |
| 2014/0255141 | A1 * | 9/2014 | Koure | B65G 47/90 414/796.2 |
| 2017/0291806 | A1 | 10/2017 | Lessing et al. | |
| 2018/0126420 | A1 | 5/2018 | Goodger et al. | |
| 2020/0376670 | A1 * | 12/2020 | Diankov | B25J 9/1687 |
| 2021/0339897 | A1 | 11/2021 | Almogy et al. | |
| 2022/0227005 | A1 | 7/2022 | Sakai et al. | |
| 2022/0267039 | A1 | 8/2022 | Craig et al. | |
| 2022/0297863 | A1 | 9/2022 | Dwyer et al. | |
| 2023/0182935 | A1 | 6/2023 | Carboni et al. | |
| 2023/0186505 | A1 | 6/2023 | Seenivasagan et al. | |

FOREIGN PATENT DOCUMENTS

| | | | | |
|---|---|---|---|---|
| JP | 2006240718 | A | 9/2006 | |
| JP | 4199912 | B2 | 12/2008 | |
| JP | 4520332 | B2 | 5/2010 | |
| JP | 5093836 | B2 | 12/2012 | |
| NL | 2014808 | A | 3/2016 | |
| WO | WO2001076946 | A1 | 10/2001 | |
| WO | WO-2019159793 | A1 * | 8/2019 | B65B 23/08 |

* cited by examiner

TRAY INSERTION SYSTEM AND METHOD

CROSS-REFERENCES TO RELATED APPLICATIONS

This application claims priority from the following U.S. patent applications: this application claims priority to, and the benefit of, U.S. Provisional Patent Application Ser. No. 63/382,958, filed Nov. 9, 2022, which is incorporated by reference herein in its entirety.

BACKGROUND

Produce, once harvested, is typically taken to a warehouse where it is sorted, sized and packaged for transportation and storage purposes. Certain types of produce, when packaged, use or require a tray insert to properly orient the produce in a box or crate. Apples and stone fruits are examples of produce typically packaged this way.

The trays used in the packaging process are typically thin molded profiles with cups for each piece of fruit to rest in. Depending on the size of the produce, the cup pattern and tray size will differ. The packaging process requires each tray to be placed inside of the box or crate once every cup on the tray has been filled. This process repeats until the appropriate number of trays are loaded into the box. The number of trays varies with the size of the produce and box or crate used.

This box filling operation has generally been done by hand; making it very labor-intensive, slow and expensive. Further, filling the boxes this way creates an environment where workers are more prone to repetitive stress injuries. Efforts have been made to automate this process, but several hurdles make it difficult. The trays and boxes commonly used are defined by industry standards or practice, and often, the trays used in the industry are wider than the opening of the box they are being put into. This makes it difficult to automate the process because the tray does not fit easily in the box. The trays are extremely pliable and prone to tearing when holding the weight of the produce. Also, the produce being handled in this type of packing operation is very susceptible to bruising. The tray being inserted on top of a tray already in the box cannot be dropped on the tray below it. To do so would certainly damage the produce on the underlying tray. Because of these limitations, prior attempts to automate the packing process for these types of produce have had significant drawbacks.

Accordingly, there is a need for a produce packing system and method that automates packing filled produce trays in boxes without bruising the produce in the process.

SUMMARY

According to one aspect of the present invention, an apparatus for packing a number of filled produce trays into a transport container, includes a produce information sensor; a processing assembly, in communication with the produce information sensor, configured to receive information from the produce information sensor to calculate a container packing position; a linear actuator assembly; and an end effector attached to an end of the linear actuator assembly. According to this aspect of the present invention, the processing assembly activates the end effector to clamp onto a filled produce tray provided to the end effector; activates the linear actuator assembly to move the filled produce tray downward into a transport container and, at the container packing position, unclamps the end effector from the filled produce tray to place the filled produce tray into the transport container.

According to another aspect of the present invention, the apparatus for packing a number of filled produce trays into a transport container may have several produce information sensors and the produce information sensors may scan for height parameters of a filled produce tray and save the height parameter data to the processing assembly. The processing assembly may calculate the container packing position from the saved height parameter data. According to yet another aspect of the present invention, the apparatus for packing a number of filled produce trays into a transport container may have a retractable infeed belt and in addition may have several tray location sensors.

According to another aspect of the present invention, the apparatus for packing a number of filled produce trays into a transport container may have several justifiers, and the justifiers may be integrated with the produce information sensor into a common assembly. The end effector of the apparatus may also include a vacuum mechanism for engaging a filled produce tray.

According to yet another aspect of the present invention, a method for packing a number of filled produce trays into a transport container, includes providing a produce packing system; having a retractable infeed belt; several produce information sensors; a processing assembly, in communication with the produce information sensors, configured to receive information from the produce information sensors; a linear actuator assembly; and an end effector attached to an end of the linear actuator assembly having a vacuum mechanism; and providing one filled produce tray; wherein the produce information sensors, scan the one filled produce tray to gather data about the one filled produce tray; calculate a container packing position from the gathered data about the one filled produce tray; activate the end effector to clamp onto and provide suction to the one filled produce tray; activate the linear actuator assembly to move the one filled produce tray downward into a transport container; and deactivate the suction and unclamp the end effector from the one filled produce tray at the calculated container packing position to place the one filled produce tray into the transport container.

According to another aspect of the present invention, the method for packing a number of filled produce trays into a transport container, where the one filled produce tray is one of a number of filled produce trays; the processing assembly calculates a container packing position for each of the number of filled produce trays and places each of the number of filled produce trays at the respective calculated container packing position in the transport container; the processing assembly stores a maximum amount of filled produce trays that can be stored in the transport container; and the processing assembly tracks the amount of filled produce trays that have been placed in the transport container; where when the processing assembly determines that the stored maximum amount of filled produce trays that can be stored in the transport container is recached, the processing assembly stops the process for that transport container, such that no more filled produce trays can be placed in the transport container. According to another aspect of the present invention, the method for packing a number of filled produce trays into a transport container, where the produce packing system further includes a number of justifiers that are integrated with the number of produce information sensors in a common assembly; and aligns the one filled produce tray in preparation for the end effector while the produce packing system scans the one filled produce tray to gather data about the next one filled produce tray.

DRAWINGS

Objects, features, and advantages of the present invention will become apparent upon reading the following description in conjunction with the drawing figures, in which.

DESCRIPTION

Figure 1:
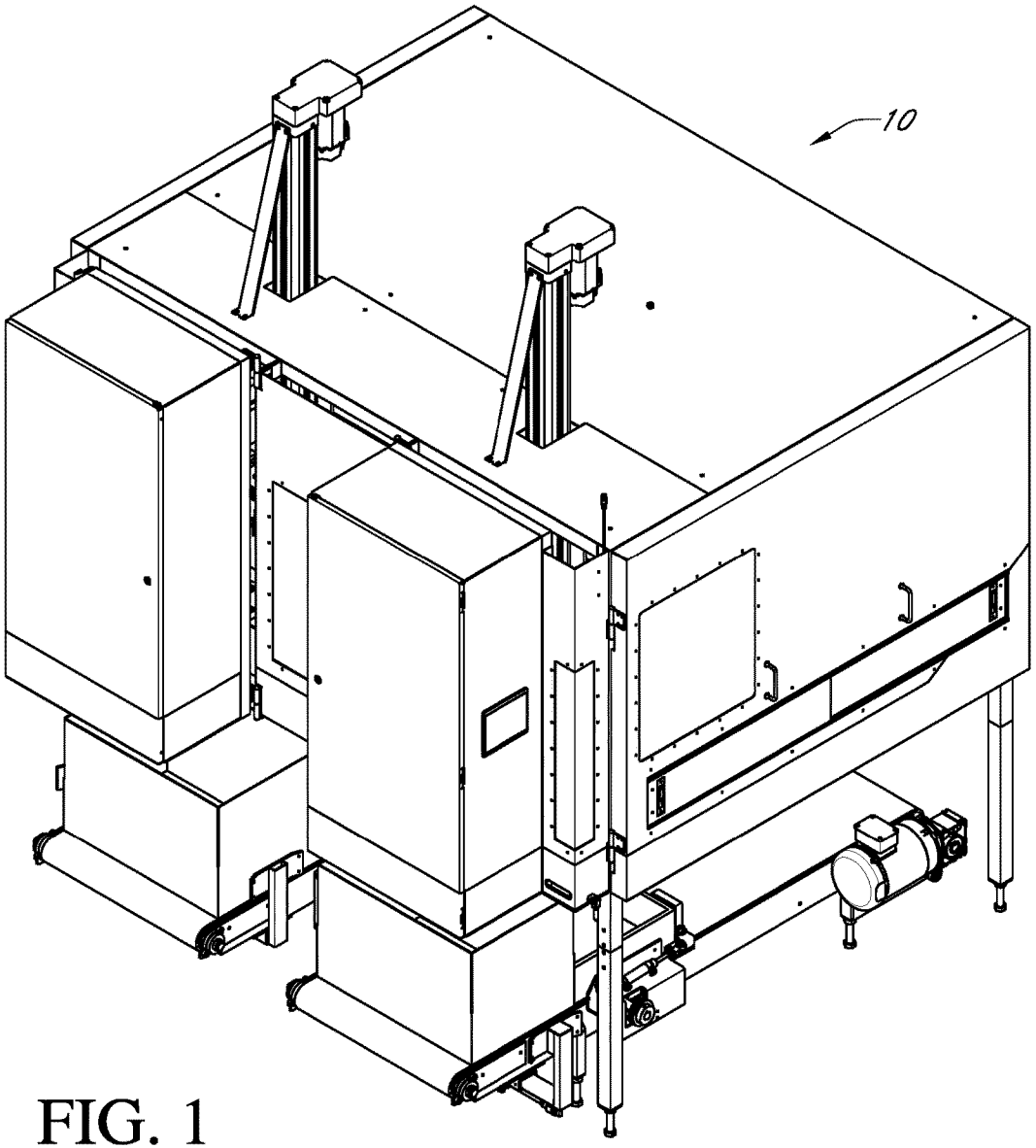
FIG. 1 is a perspective view of an embodiment of a produce packing system of the present invention.
Figure 2:
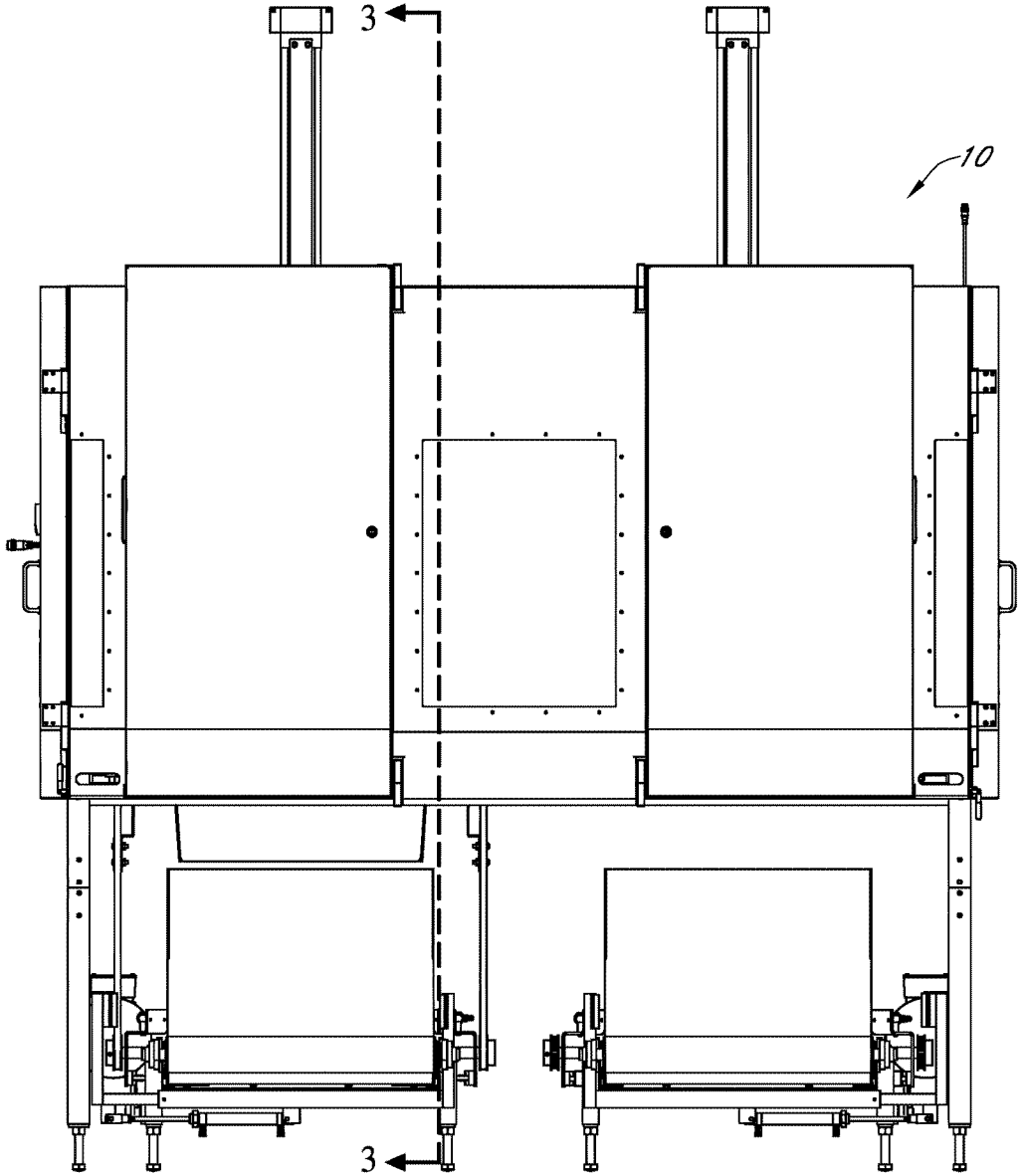
FIG. 2 is an end view of an embodiment of a produce packing system of the present invention.
Figure 3:
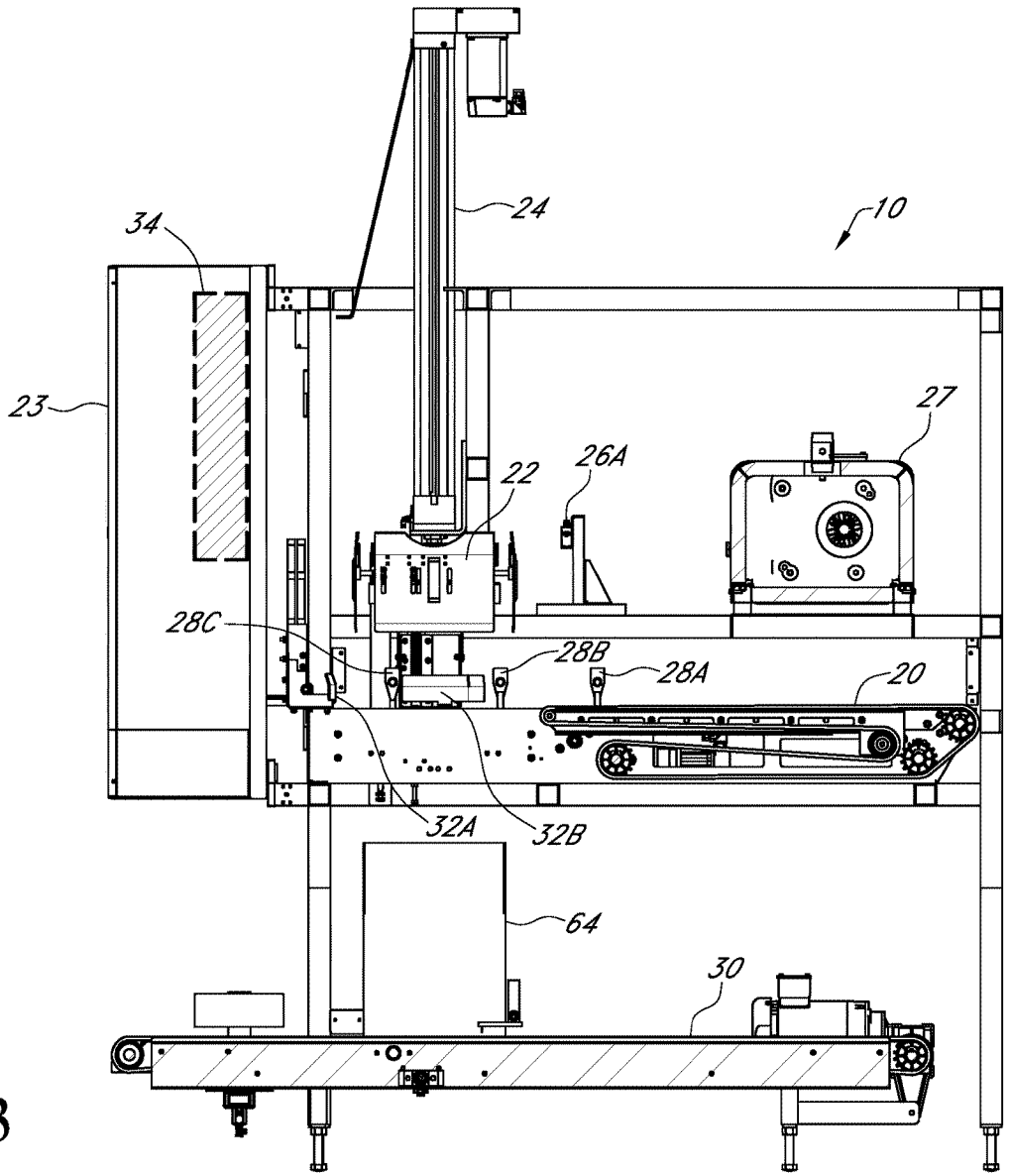
FIG. 3 is a cross sectional view along cross section 3-3 of FIG. 2.
Figure 4:
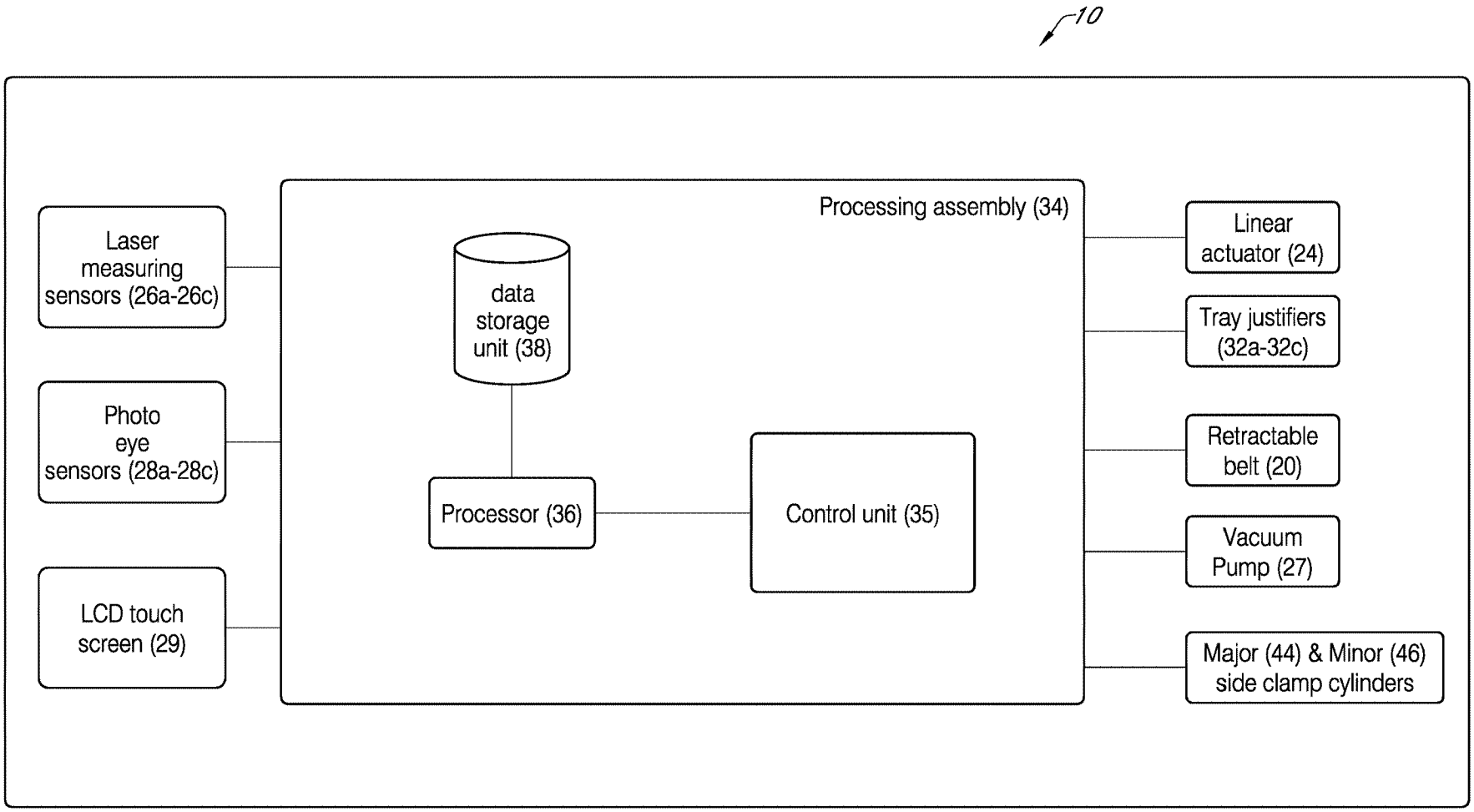
FIG. 4 is a block diagram illustrating a configuration of an exemplary control system of a produce packing system of the present invention.

Referring to FIGS. 1, 2 and 3, an embodiment of a produce packing system 10 of the present invention is depicted. Referring specifically to FIG. 3, the produce packing system 10 depicted includes, among other items, an infeed belt 20, an end effector 22, a machine control box 23, a linear actuator assembly 24, produce information sensors 26*a*-26*c* (FIGS. 3, 12), location sensors 28*a*-28*c*, an extraction belt 30, a vacuum pump 27, justifiers 32*a*-23*c* (FIGS. 3, 13) and a processing assembly 34 contained within the machine control box 23. In this embodiment, the other half of the produce packing system 10 not depicted in FIG. 3 has similar components to the portion depicted. As explained in detail below, the locations sensors 28*a*-28*c* locate a tray 50 (FIG. 9) of produce and, with the justifiers 32*a*-32*c*, control the infeed belt 20, starting and stopping the belt 20 at desired times and positions. It should be understood that the number and type of produce information sensors 26 and location sensors 28 may vary depending on application and need and there are numerous various embodiments of the present invention using different sensor configurations. Referring to FIG. 4, in this embodiment, the processing assembly 34 includes a control unit 35, a processor 36 and a data storage unit 38. Further, in this embodiment, in addition to other items, the produce information sensors 26*a*-26*c* and the location sensors 28*a*-28*c* communicate with the processing assembly 34.

Figure 5:
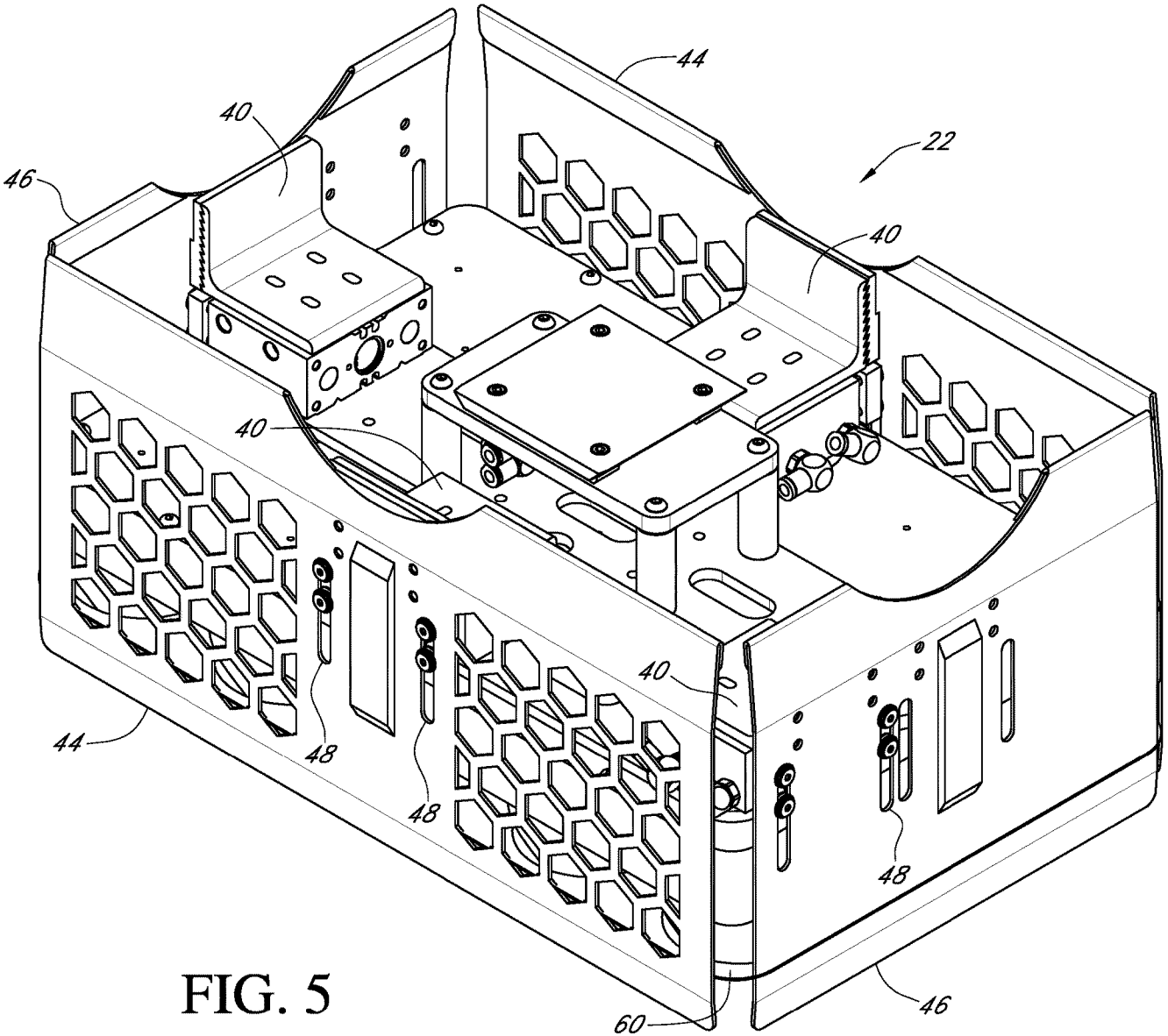
FIG. 5 is a perspective view of an end effector of an embodiment of a produce packing system of the present invention.
Figure 6:
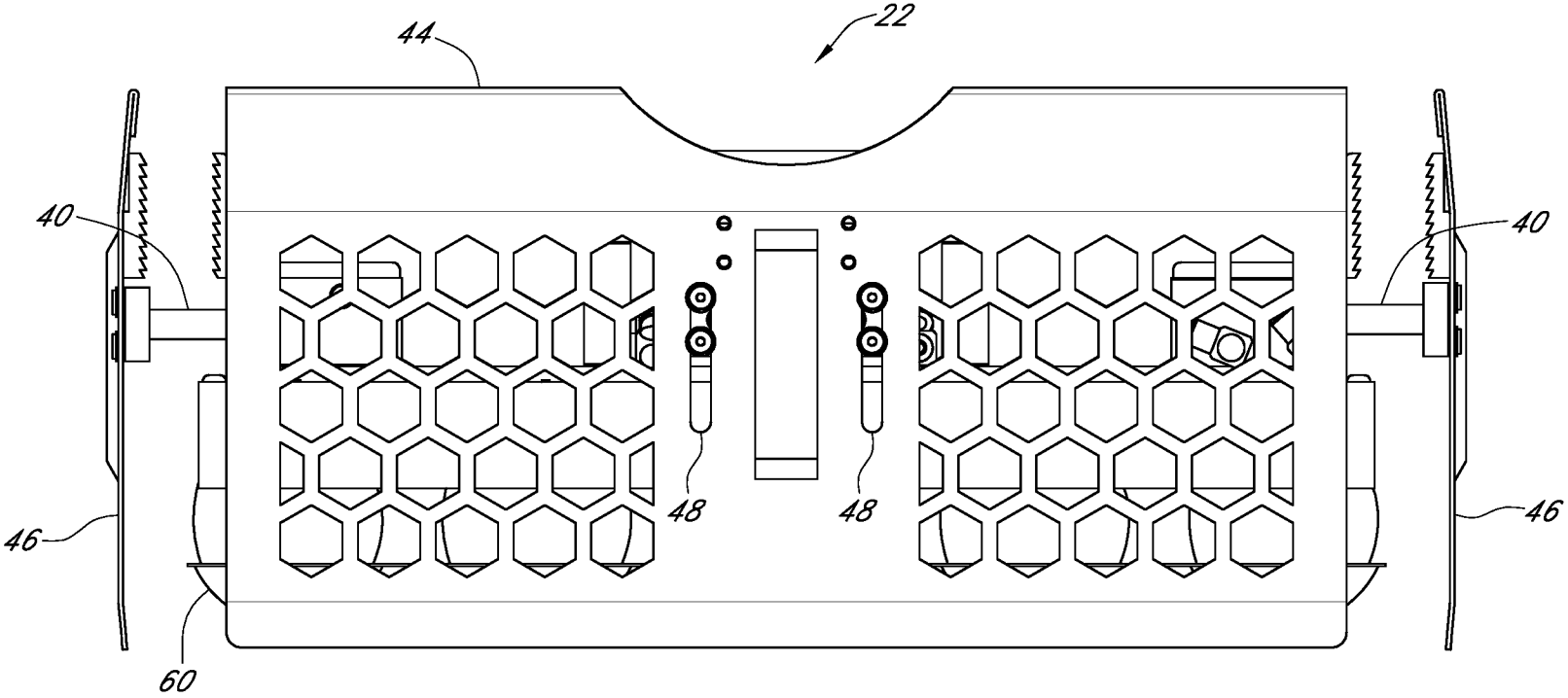
FIG. 6 is a side view of an end effector of an embodiment of a produce packing system of the present invention.
Figure 7:
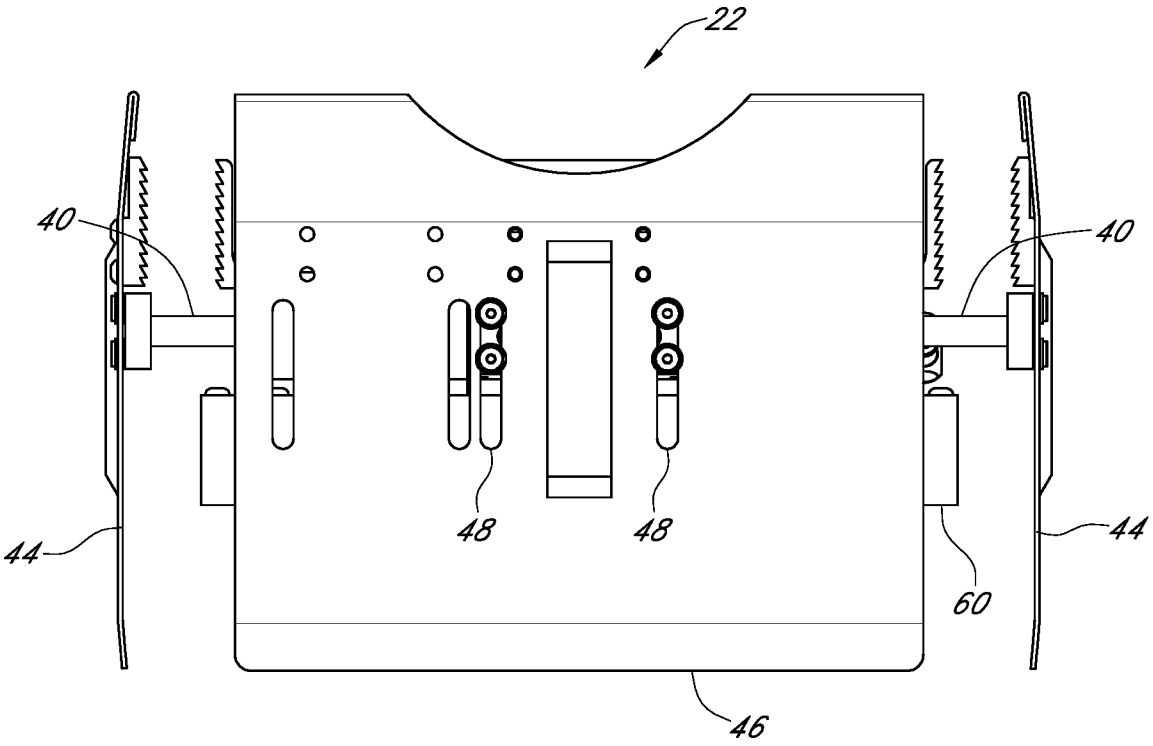
FIG. 7 is an end view of an end effector of an embodiment of a produce packing system of the present invention.

As explained in detail below, the end effector 22 is the mechanism that engages a tray 50 of produce and moves it into a transport container, such as a box or crate. The end effector 22 has a number of components. Referring to FIGS. 5, 6 and 7, an embodiment of the end effector 22 of the present invention includes actuators 40, major clamp plates 44, minor clamp plates 46 and a vacuum mechanism 60. Each minor clamp plate and major clamp plate 44, 46, in this embodiment, has slots 48 formed in their sidewalls to allow each clamp plate 44, 46 to move freely upward and downward until engaged. It should be understood that in other embodiments the position, style, and number of pneumatic actuators 40 could be changed. Similarly, in other embodiments, the look, flange angles, lengths and adjustability of the minor and major clamp plates 44, 46 may vary as well.

Figure 8:
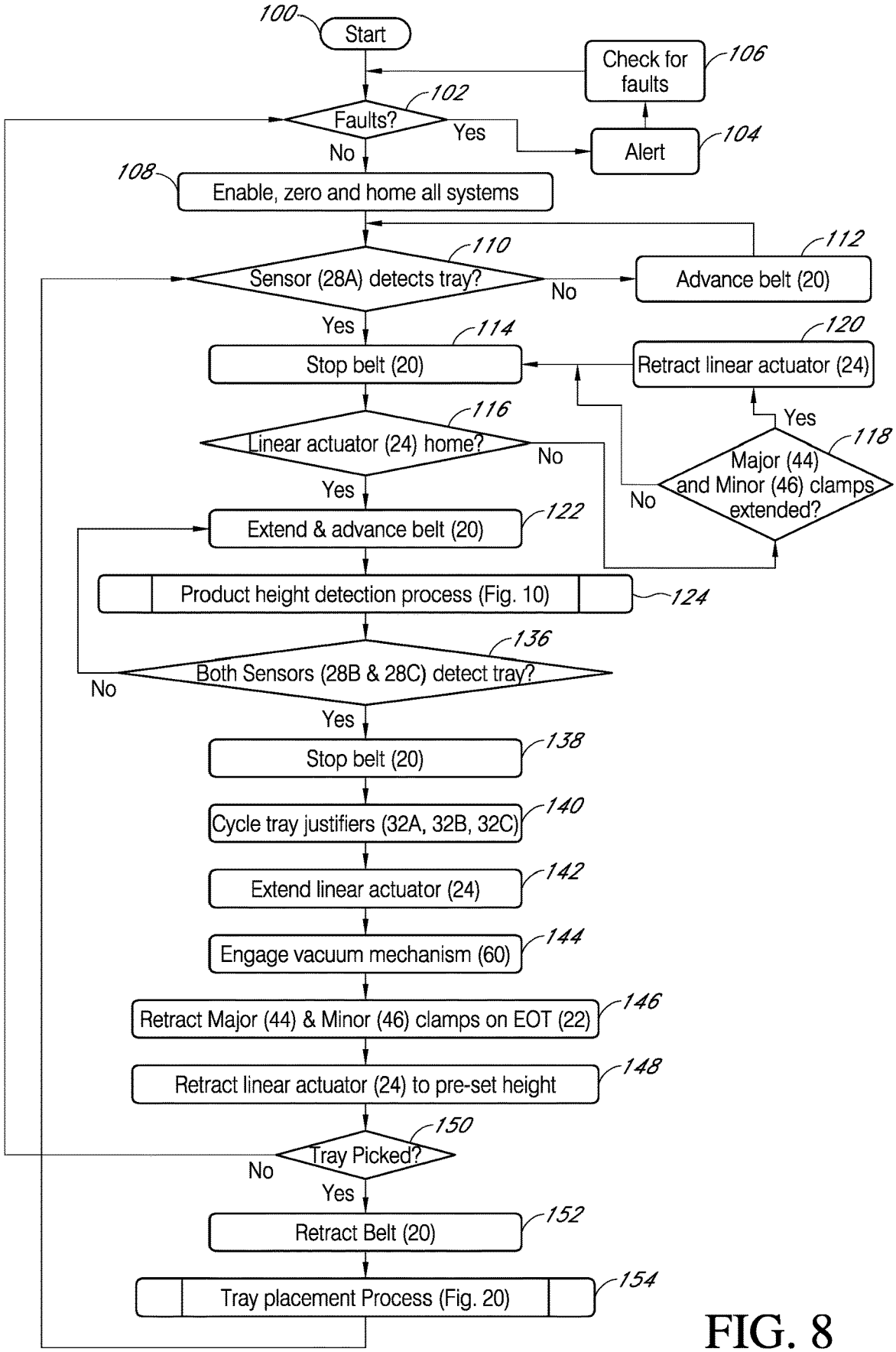
FIG. 8 is a flowchart illustrating the flow of an embodiment of a process executed by the produce packing system of the present invention.

Referring now to FIGS. 8-22, the operation of an embodiment of a produce packing system 10 of the present invention is explained. FIG. 8 depicts a flowchart of an embodiment of the process implemented by the control unit 35 during a cycle of the produce packing system 10. When turned on, the produce packing system 10 remains in a standby state until activated by a user. A user activates the produce packing system 10 by entering the desired number of trays per box and pressing the start button on an LCD screen. The information entered by the user is stored in data storage unit 38 and used by the control unit 35 to determine the parameters of the cycle. Once the user enters the cycle information and places a tray of produce 50, in this example, apples, on the infeed belt 20 of the produce packing system 10, the user presses a start button and the machine starts the process shown in FIG. 8 and in the position shown in FIG. 9.

The cycle is started (step 100). At step 102, the system is checked for faults. If a fault is detected, the process alerts the user and prompts the user to check for faults (steps 104, 106). If at step 102, no faults are detected, the process, at step 108, sets all systems to zero, homes the actuator components to home state and all functions are enabled. Then, at step 110, if the sensor 28*a* does not detect a tray 50, the control unit 35 signals the infeed belt 20 to advance (step 112). However, if at step 110, the sensor 28*a* does detect a tray 50, the process, at step 114, stops the infeed belt 20.

Figure 9:
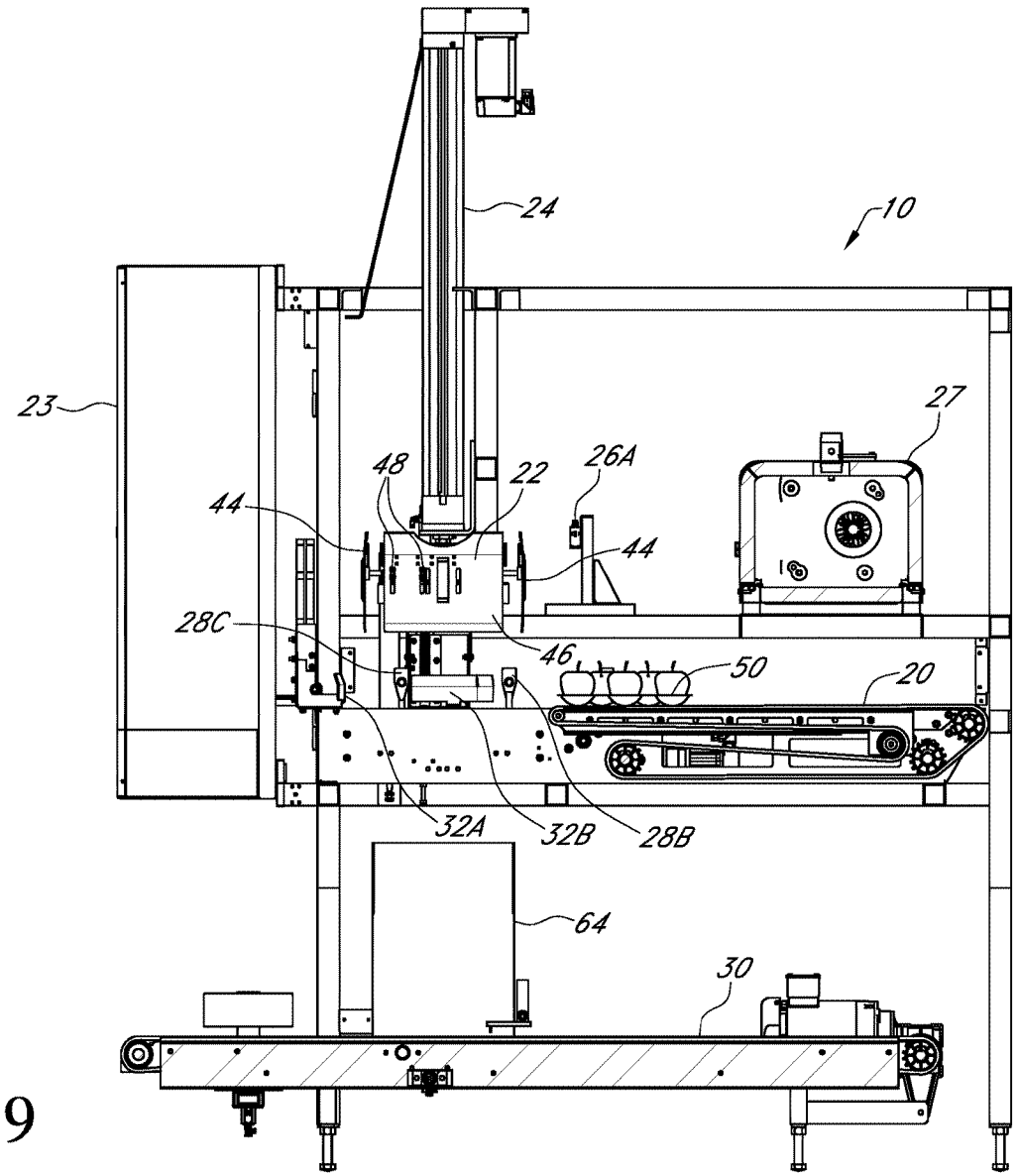
FIG. 9 is a side sectional view depicting a step in the process of the produce packing system of the present invention.

The tray 50, if the first tray, is now ready to begin the first placement cycle. If the tray 50 is one or more of the follow-on trays, the cycle continues until complete as set by the user's parameters. At step 116, the process checks the linear actuator 24 to determine if it is in the fully retracted home position. If not, at step 118, the process checks if the major clamps 44 and minor clamps 46 located on the end effector 22 are extended. If the clamps 44 and 46 are extended, at step 120, the process retracts the linear actuator 24. If the clamps 44 and 46 are not extended, the process proceeds to step 114 again. The process continues in this loop until the linear actuator 24 is in the home position as shown in FIG. 9. With the linear actuator 24 in the home position, the process, at step 122, re-starts advancement of the retractable belt 20. Then, at step 124, when the produce information sensors 26*a*-26*c* detect a tray 50 (FIG. 11), the process executes the product height detection process.

Figure 10:
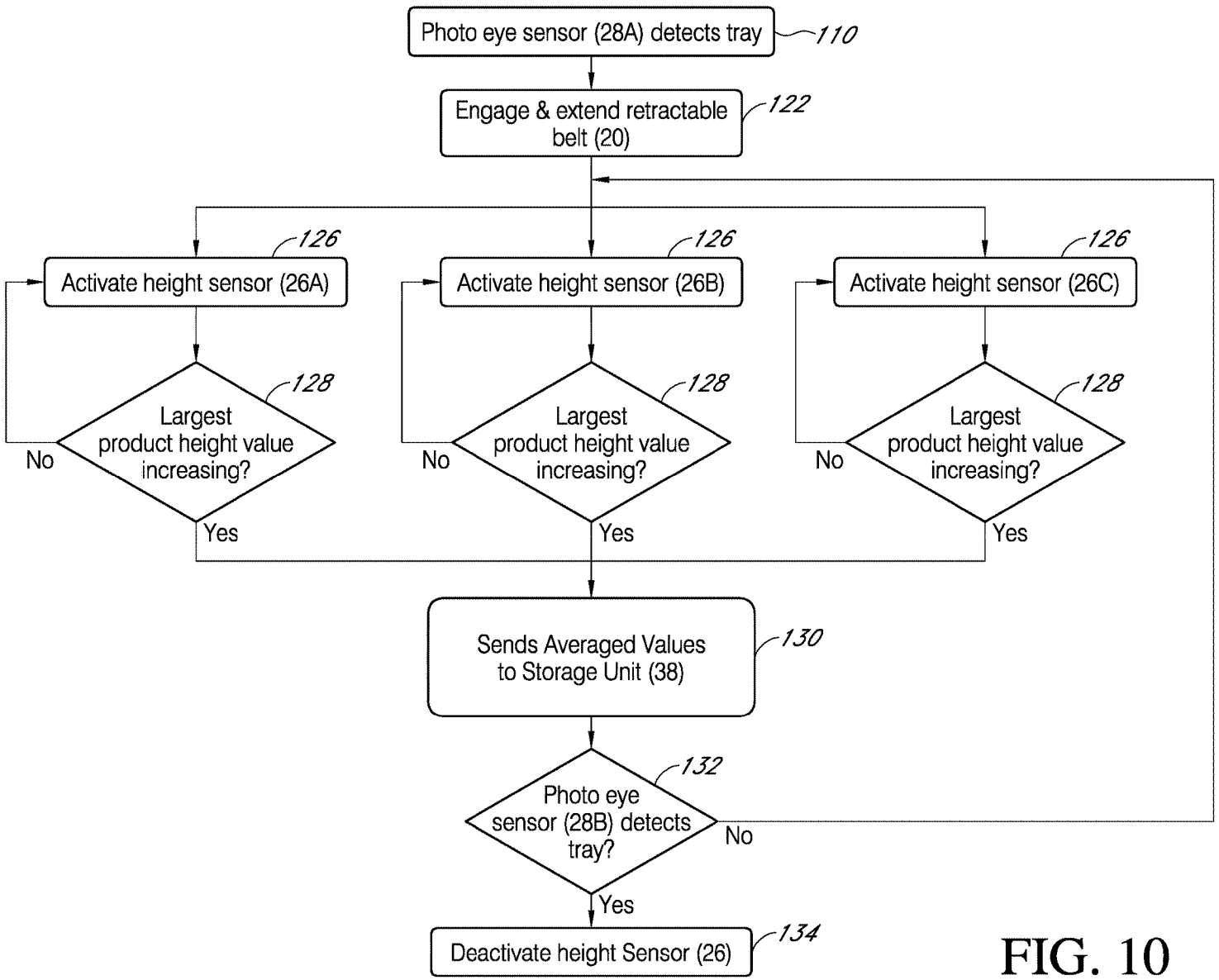
FIG. 10 is a flowchart illustrating the flow of an embodiment of a container packing parameter position calculation process of the produce packing system of the present invention.
Figure 11:
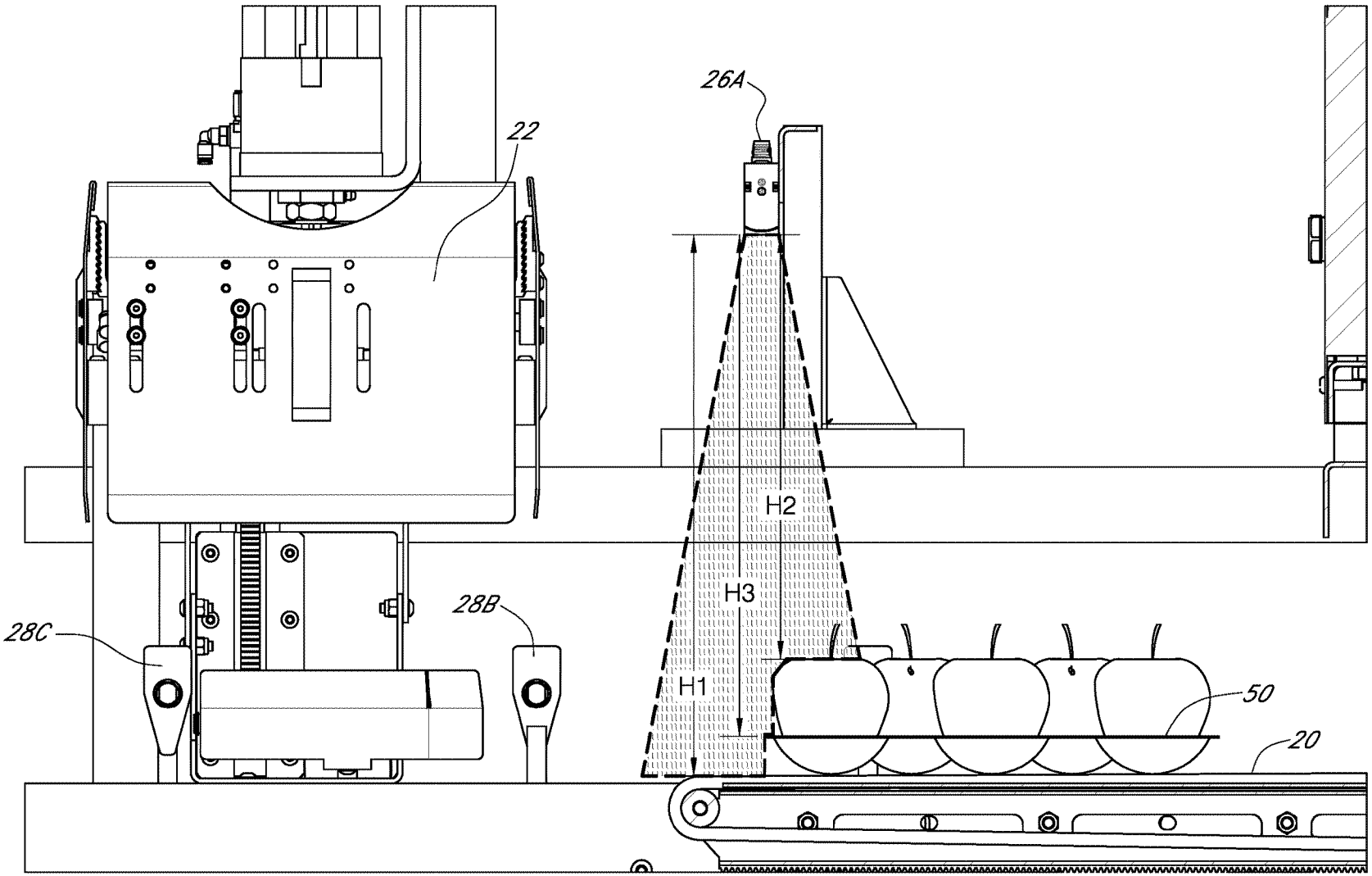
FIG. 11 is a descriptive view depicting sensor information collection in a container packing parameter position calculation process of the produce packing system of the present invention.

Referring now to FIGS. 10 and 11, the process starts the product height detection process. At steps 126, the belt 20 is extending outward, with the tray 50 on it. The tray 50 travels underneath the produce information sensors 26*a*-26*c* (e.g., height sensors in this embodiment) and the height sensors 26*a*-26*c* each transmit the information detected to the processing assembly 34. As the tray 50 passes under the height sensors 26*a*-26*c*, the process, at step 128, using the sensors 26*a*-26*c*, measures the height of the produce on the tray 50. The process, using the information from the sensors 26*a*-26*c*, repetitively compares the distance from each sensor 26 to the retractable belt 20 (FIG. 11, "H1"), to the dynamic heights (FIG. 11, "H2" and "H3") from each sensor 26. In the embodiment depicted in FIG. 11, at step 130, the process transmits the difference between H2 and H1 to the data storage unit 38. The difference between H3 and H1 is overridden since it is a smaller value than the difference between H2 and H1. The process continues to measure the difference between H2 and H1 as the tray 50 moves under the sensors 26*a*-26*c*. A difference greater than the previous one is constantly being evaluated and stored until the location sensor 28*b* detects the tray 50, (step 132). The process continues to overwrite the previous H2 minus H1 value if the previous H2/H1 value is smaller than the newly measured H2/H1 value. The process ultimately calculates the largest H2 minus H1 value for the tray 50 under the sensors 26*a*-26*c* for use in calculating where the tray 50 should be placed in the box 64. The process, then, at step 134, deactivates produce information sensors 26*a*-26*c* and the product height detection process ends. It should be understood that the information gathered by sensors 26 can be any information that a user wants to collect. In this embodiment, the produce height sensors 26*a*-26*c* gather information that the processing assembly 34 uses to determine the size or height of the apples on the tray 50 as previously described.

Figure 12:
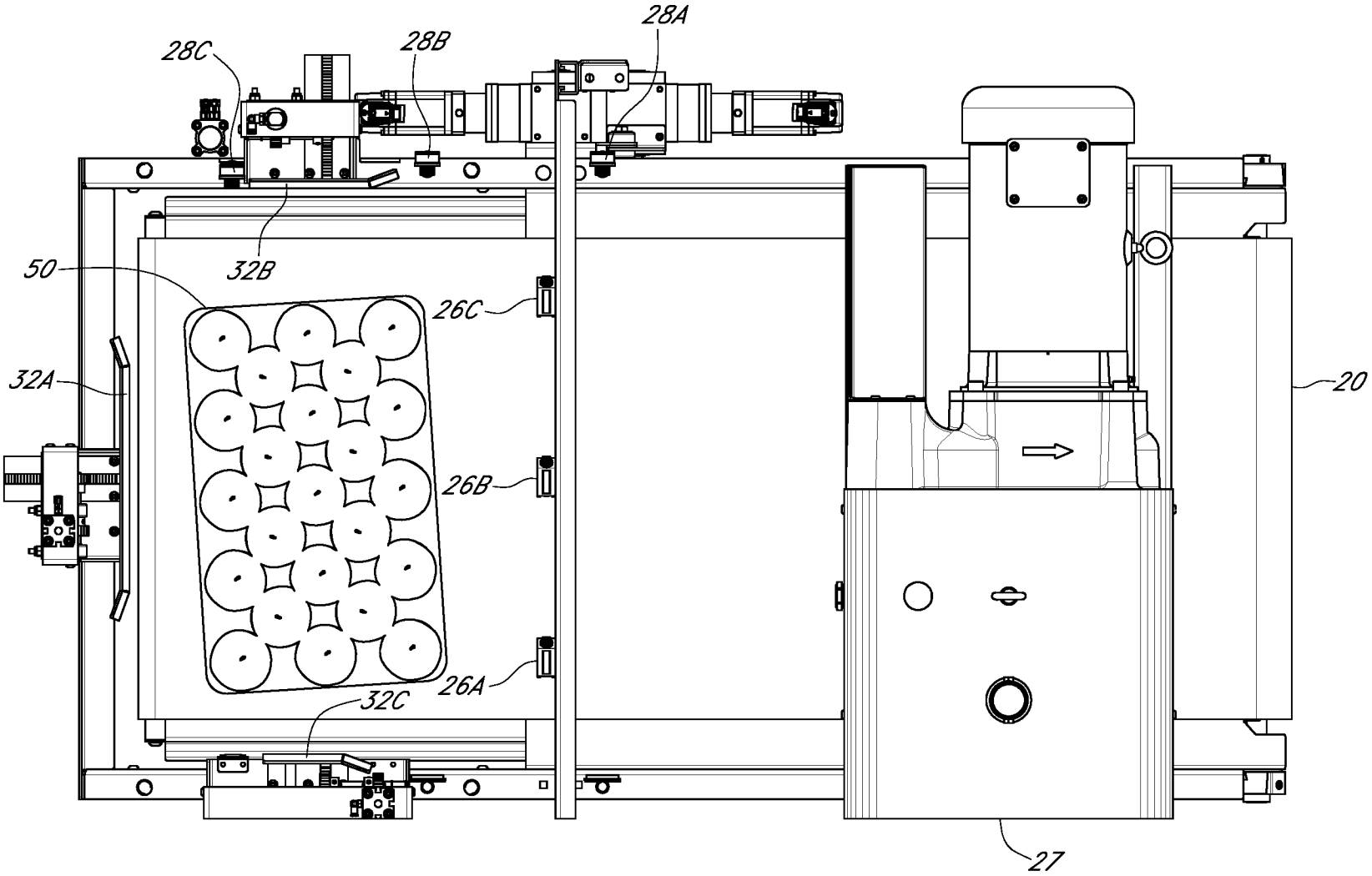
FIG. 12 is a top plan view depicting an alignment step in the process of the produce packing system of the present invention.
Figure 13:
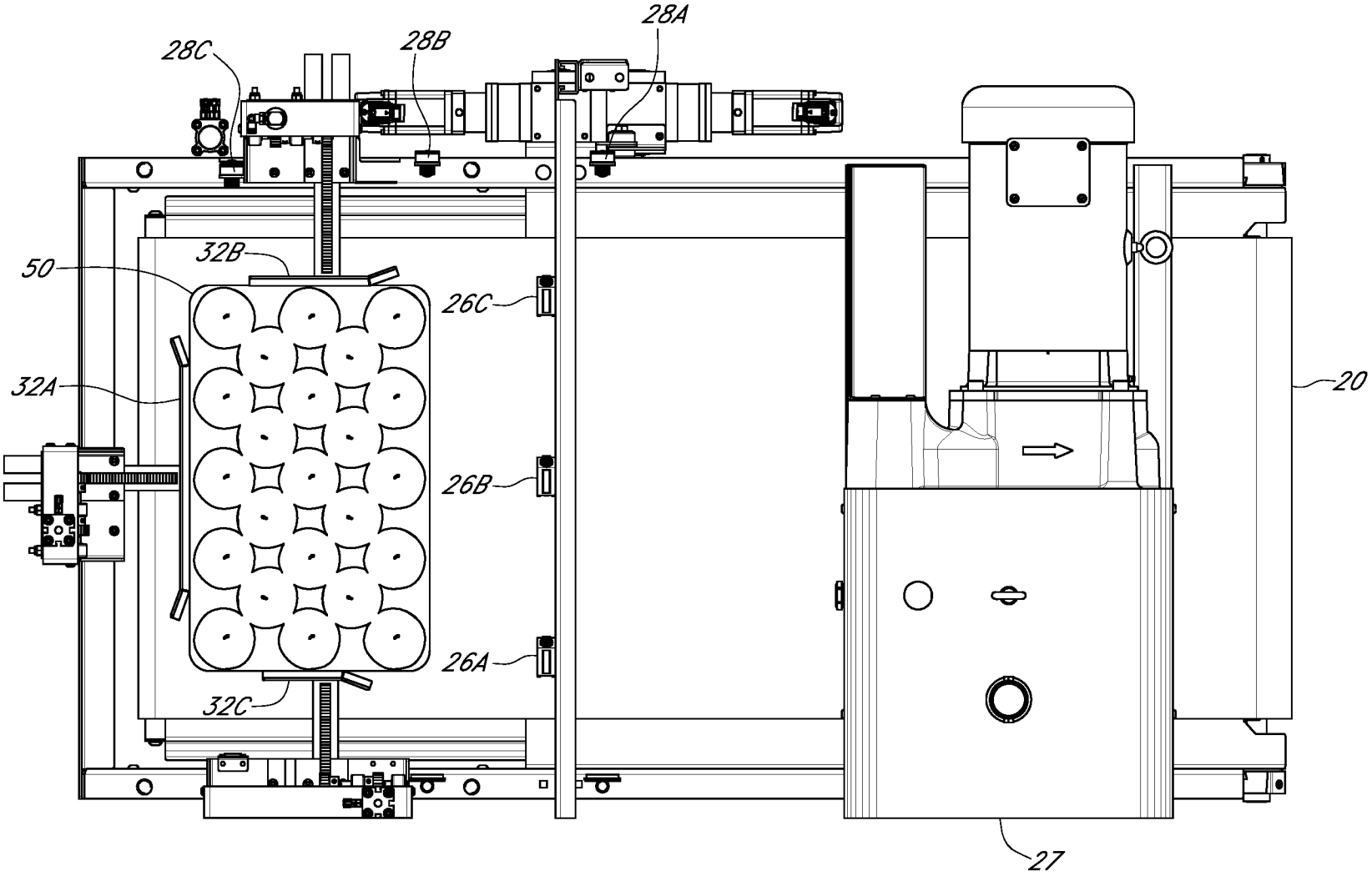
FIG. 13 is a top plan view depicting another alignment step in the process of the produce packing system of the present invention.
Figure 14:
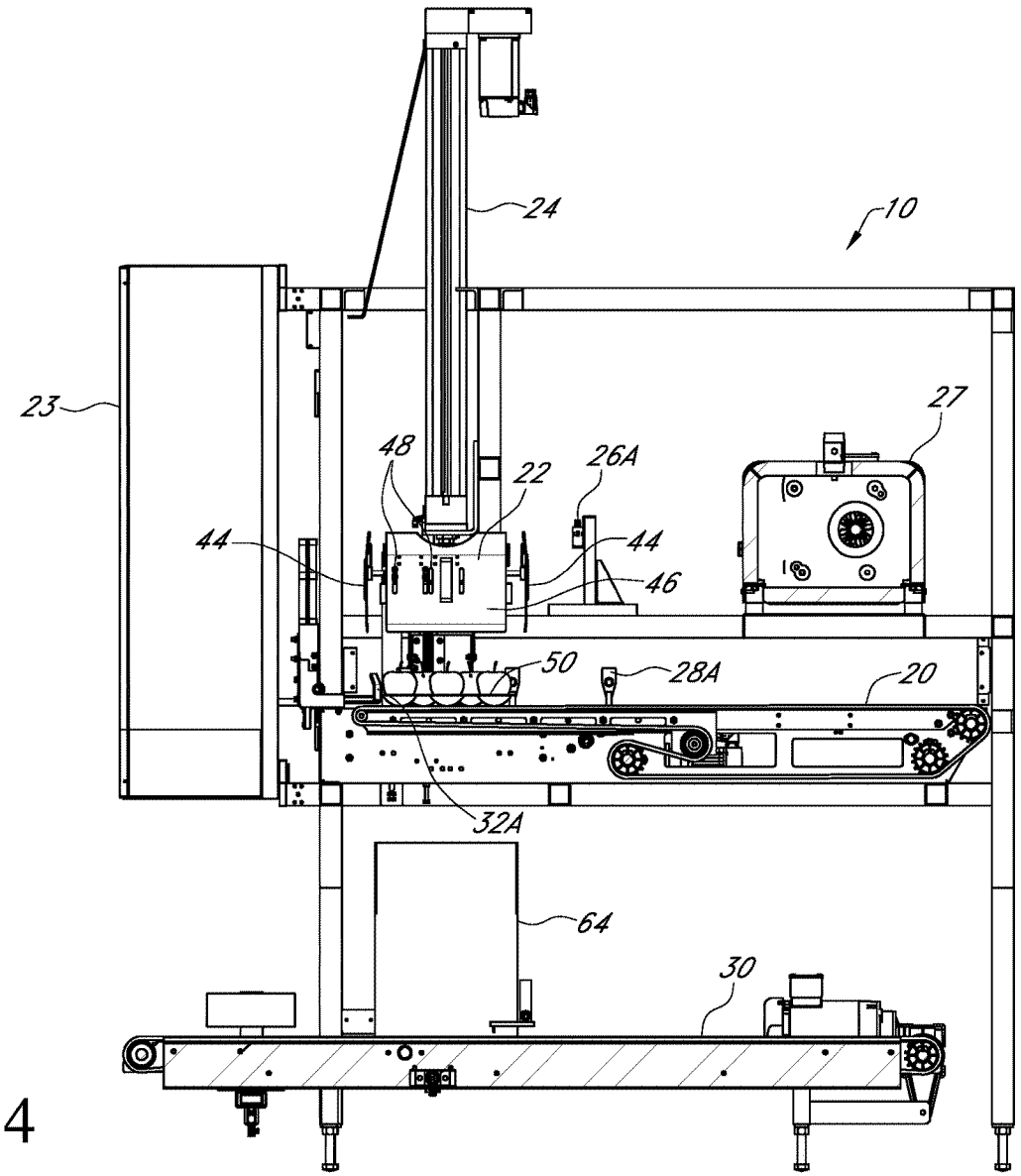
FIG. 14 is a side sectional view depicting a step in the process of the produce packing system of the present invention.

Referring again to FIG. 8, the retractable belt 20 has been continuing to advance through the product height detection process and continues to advance forward towards the end effector 22 until both sensors 28*b*, 28*c* detect the tray 50 at step 136 (FIG. 12), at which point, the process stops the retractable belt 20 (step 138). Referring now to FIGS. 12 and 13, the process, at step 140, cycles the tray justifiers 32*a*, 32*b* and 32*c* to align the tray 50 underneath the linear actuator 24. The process, at step 140, ensures that any misalignment of the tray 50 is corrected before engaging the tray 50 with the linear actuator 24. Referring to FIG. 14, the tray 50 is now aligned with the overhead linear actuator 24 and ready to be placed in a box 64 below.

Figure 15:
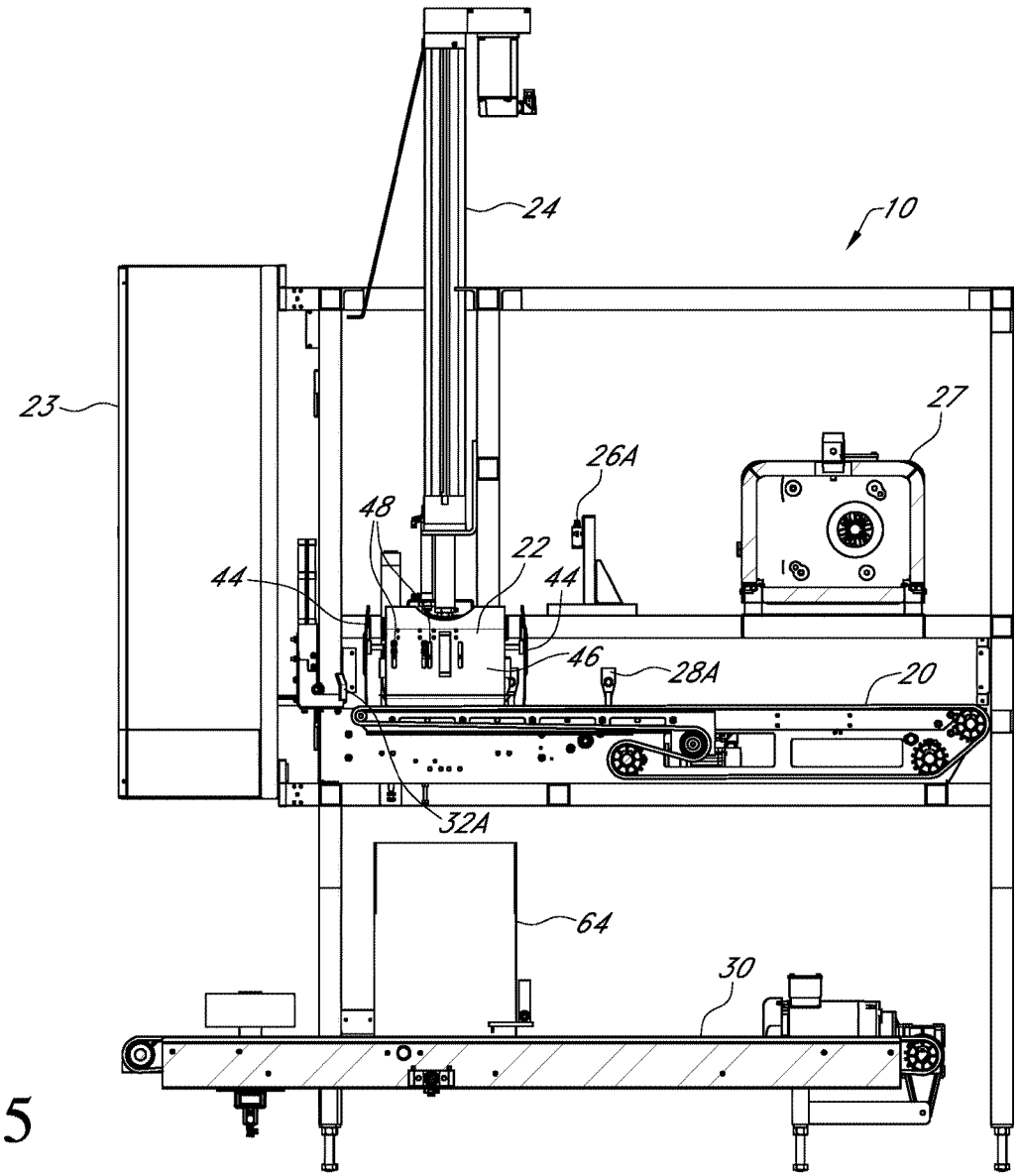
FIG. 15 is a side sectional view depicting a step in the process of the produce packing system of the present invention.
Figure 16:
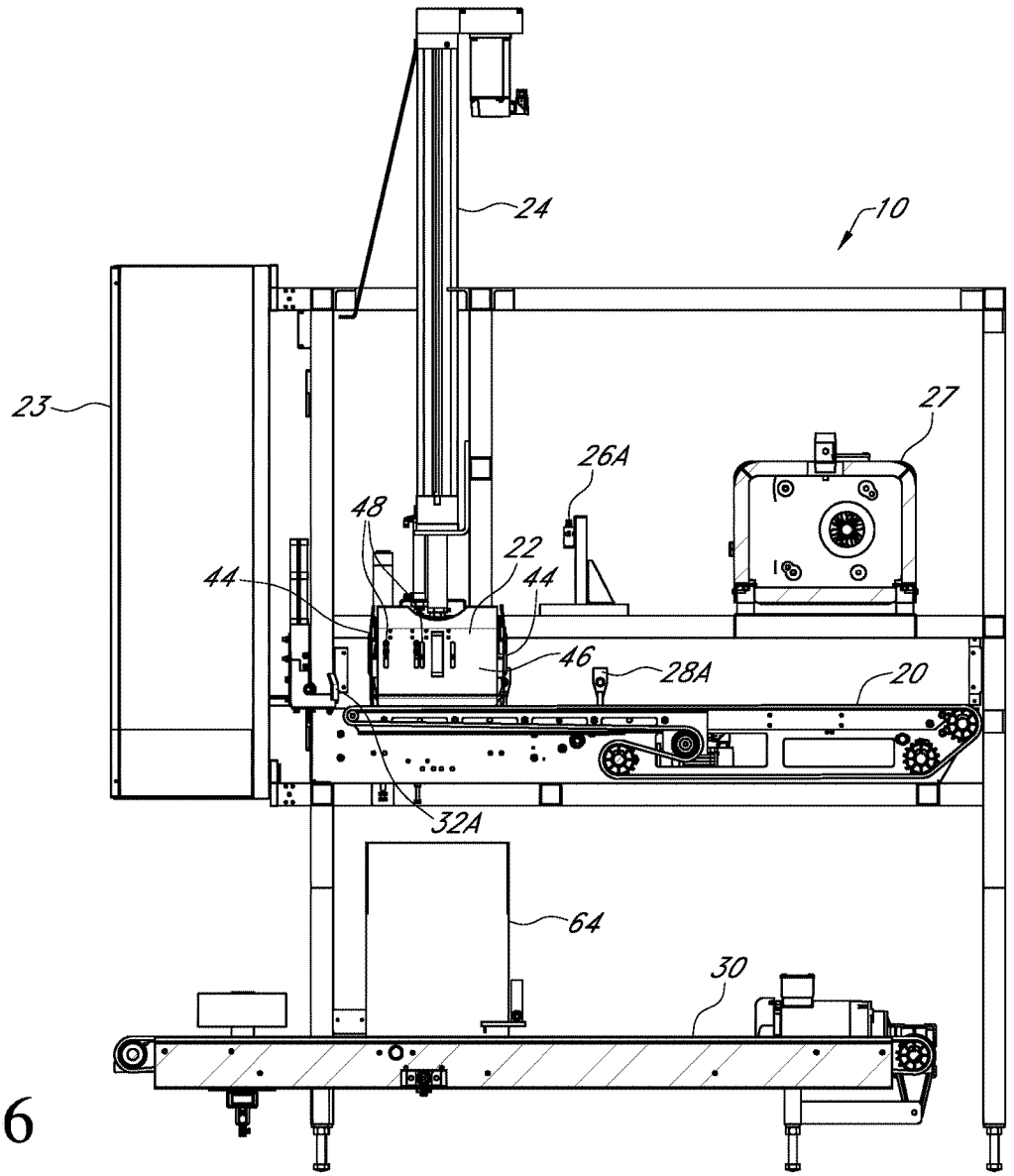
FIG. 16 is a side sectional view depicting a step in the process of the produce packing system of the present invention.
Figure 17:
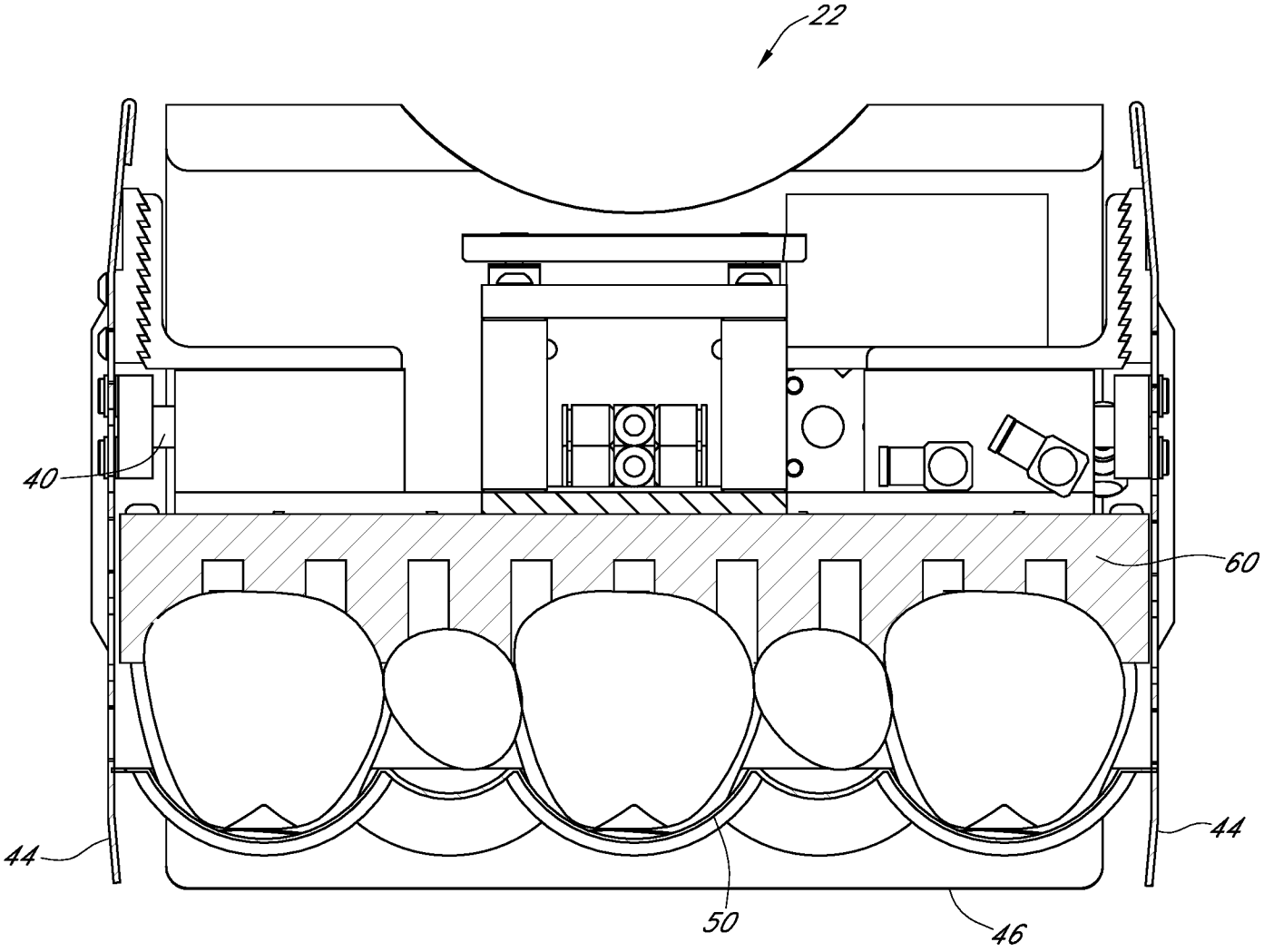
FIG. 17 is a side sectional view depicting an end effector of the present invention clamping a filled produce tray.

At step 142, the process extends the linear actuator 24 downward to the stored average height value determined by the processing assembly at step 124 (FIG. 15). At this point, at step 144, the process activates the vacuum pump 27 which creates suction on the tray 50 through the vacuum mechanism 60 (FIG. 17). Next, at step 146, the process retracts the major 44 and minor 46 side clamps 44, 46 of the end effector 22 ("EOT") (FIG. 16). Referring now to FIGS. 7 and 17, in order to account for different sized products, the minor and major clamp plates 44, 46 can freely slide up and down along slots 48 when the pneumatic actuators 40 are in the extended position. This configuration allows the vacuum mechanism 60 of the end defector 22 to reach and form to the produce, apples in this embodiment, at several heights depending on their size, with automatic adjustment of the side clamps 44, 46. The side clamps 44, 46 then retract, and the vacuum mechanism 60 engages the tray 50. This process of clamping the tray 50 at the optimal height while applying a vacuum, holds the tray 50 in a relatively flat or horizontal position, as depicted in FIG. 17. With the produce packaging system 10 of the present invention, as explained herein, the three aspects of adjustability, grip pressure and vacuum working together keeps the tray 50 from sagging in the middle while engaged by the end effector 22, which allows the tray 50 to be placed in the box 64.

Figure 18:
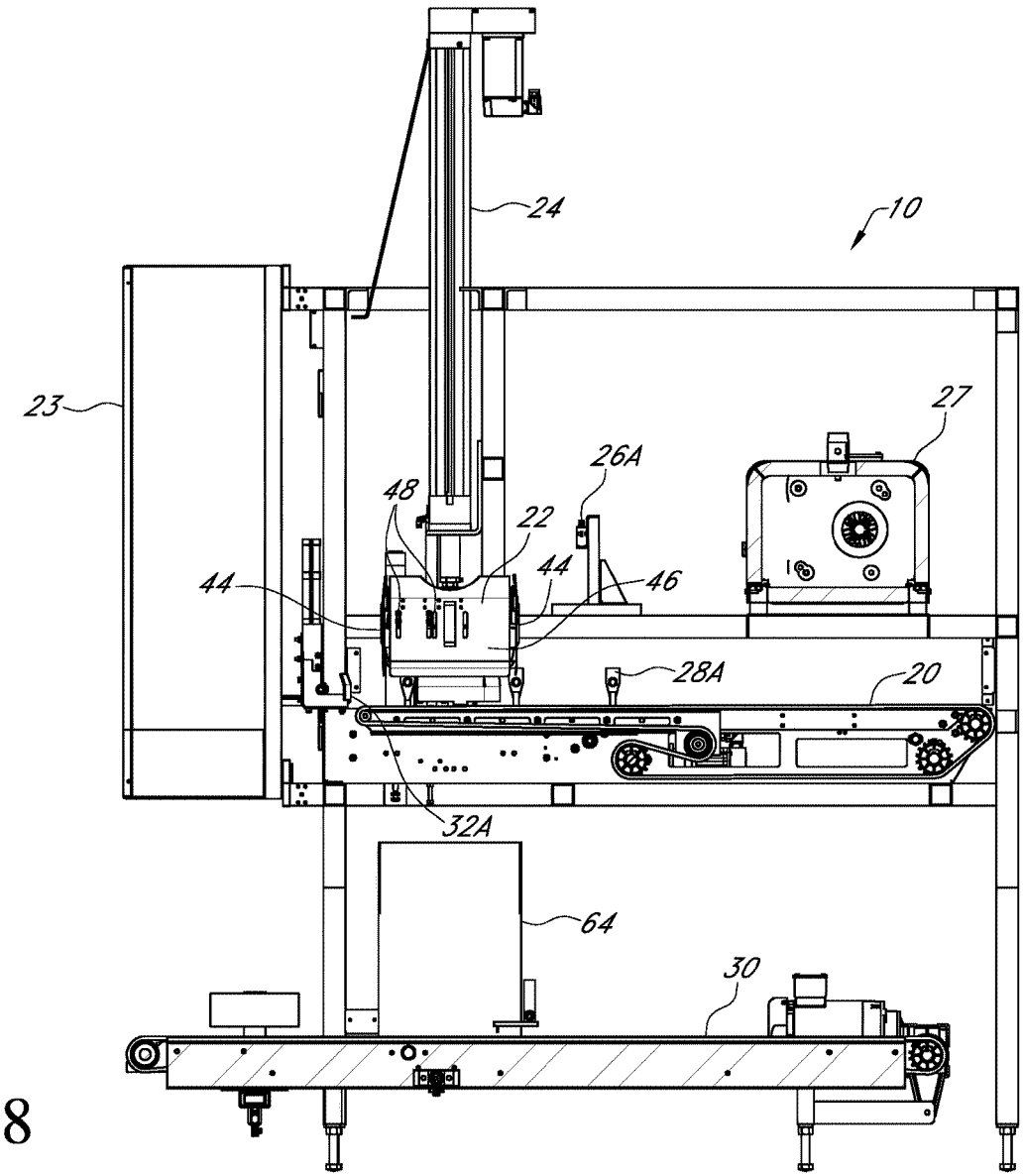
FIG. 18 is a side sectional view depicting a step in the process of the produce packing system of the present invention.
Figure 19:
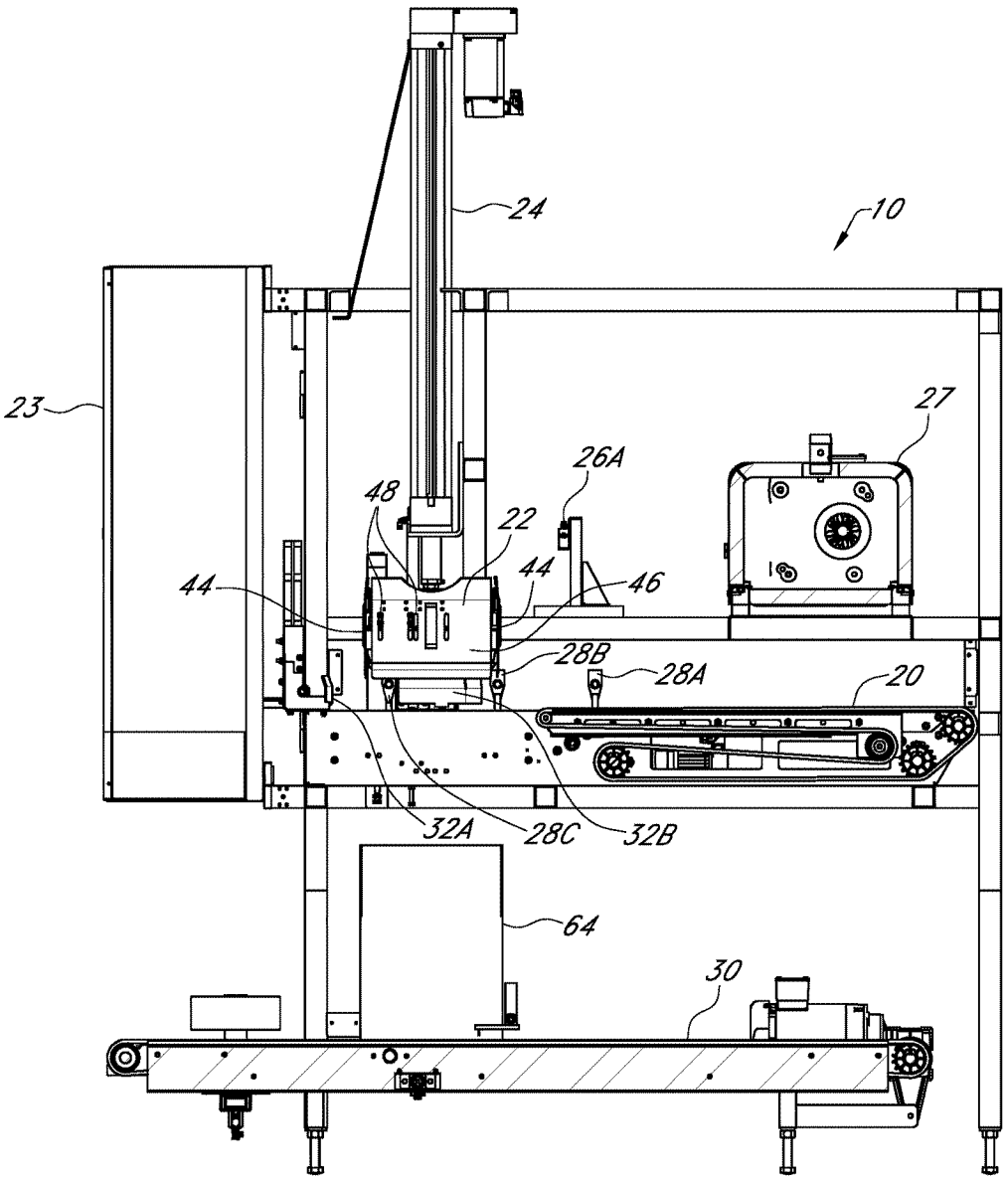
FIG. 19 is a side sectional view depicting a step in the process of the produce packing system of the present invention.

Referring now to FIGS. 8 and 18, at step 148, the linear actuator 24 now retracts to a preset height. At step 150, the process checks to see if the tray 50 has been picked up using feedback from sensors 28*b* and 28*c*. If the tray 50 is detected by the sensors 28*b* or 28*c*, the process faults, reverting back to step 102. If sensors 28*b* and 28*c* do not detect the tray 50, then, at step 152 (FIG. 19), the process retracts the retractable belt 20. Then, at step 154, the process executes the tray placement process.

Figure 20:
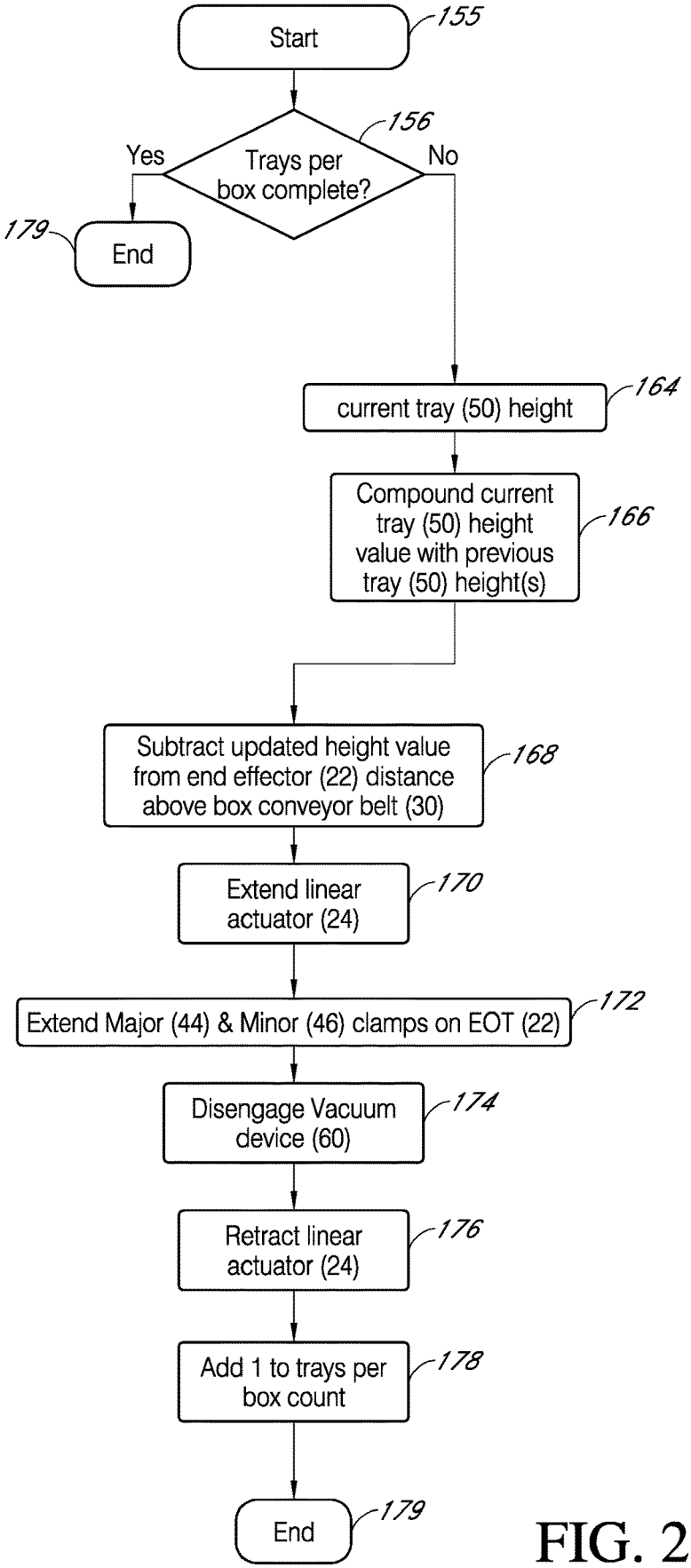
FIG. 20 is a flowchart illustrating the flow of an embodiment of a tray placement process of the produce packing system of the present invention.
Figure 21:
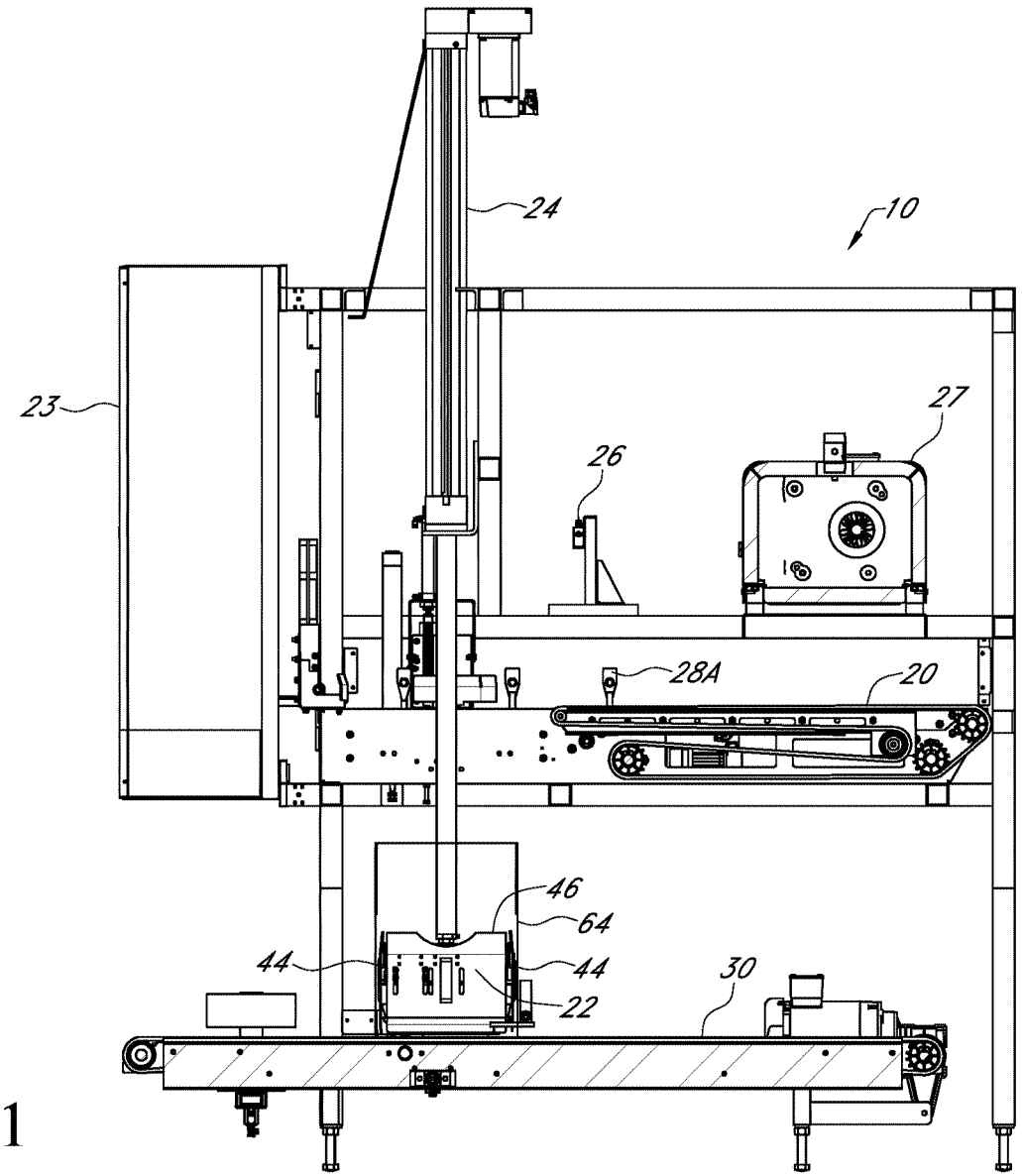
FIG. 21 is a side sectional view depicting a step in the process of the produce packing system of the present invention.
Figure 22:
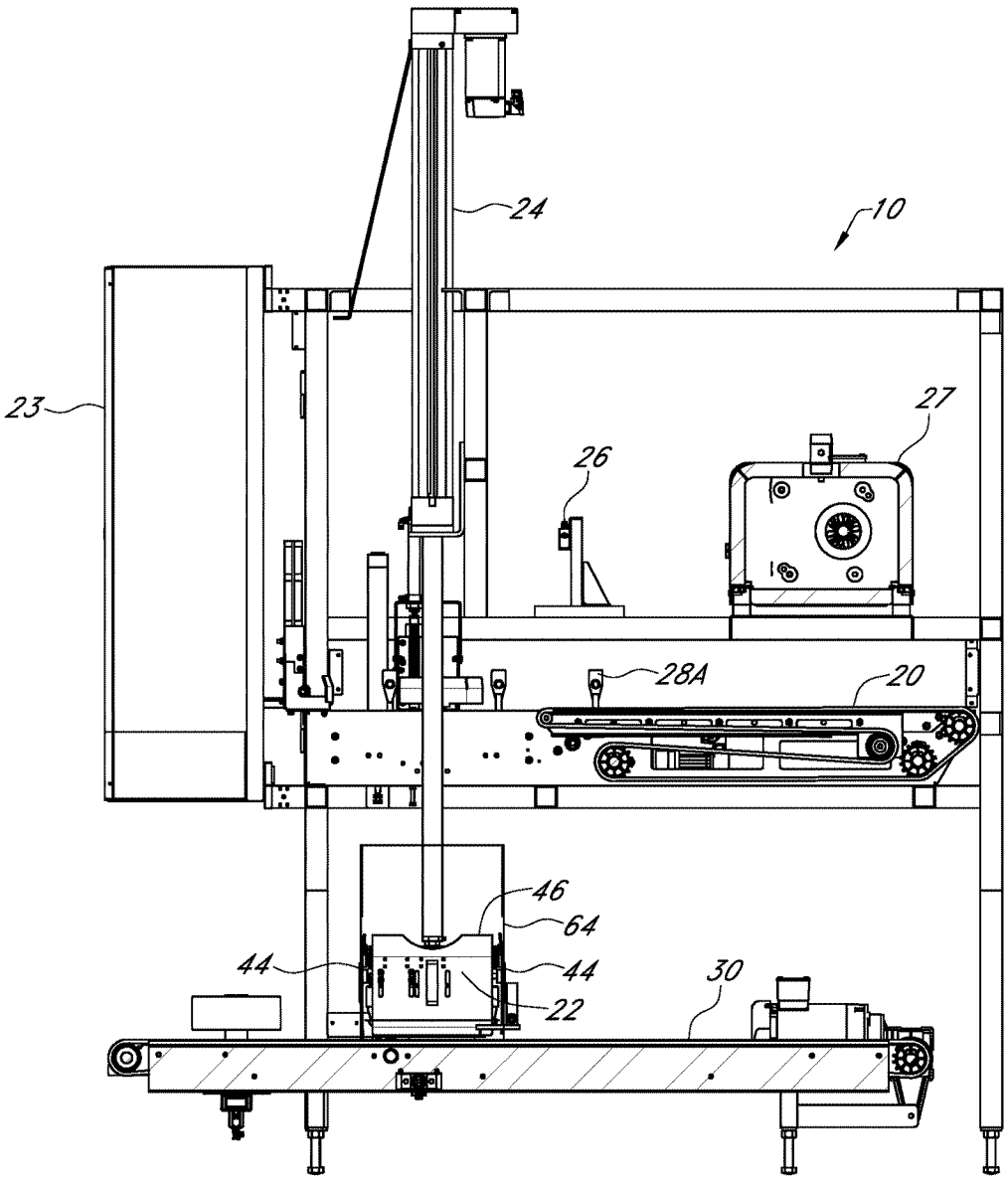
FIG. 22 is a side sectional view depicting a step in the process of the produce packing system of the present invention.

Referring now to FIG. 20, at step 155, the process starts the tray placement process. At step 156, the process checks to see how many trays 50 have been placed in the box 64. It is important to note that, in this embodiment, at this point in the process, the process simultaneously starts again at step 100 for a new tray 50 in order to have the next tray 50 ready when the linear actuator 24 returns home. At step 156, if the number of trays 50 matches the required trays 50 per box 64, the process ends at step 179 because the tray packing cycle is complete. If the number of trays 50 in the box is less than the desired trays in the box, at step 164, the current height of tray 50 in end effector 22 is gathered from the storage unit 38. At step 166, the process retrieves that height value and compounds it with the previously stored compounded height values. For example, if there are five required trays 50 per box 64 and three have been placed so far with the fourth tray 50 being placed. The stored height values from each of the last three trays along with the height value of the current tray 50 in the end effector 22 are all compounded and stored. All tray height values are the tray heights found and stored during the product height detection process at step 124. Whether the desired trays 50 per box 64 was met or not, at step 168, the process, in this embodiment, takes the updated tray height either compounded or first tray 50 and subtracts that value from the presently known distance between the end effector 22 and the top of the box conveyor belt 30 to calculate a container packing position. Then, at step 170, the process extends the linear actuator 24 to that new calculated position (FIG. 21 for this example; showing the first tray 50 being placed in the box 64). Once the linear actuator 24 is at the precisely calculated height, the process, at step 172, extends the major and minor side clamps 44 and 46, releasing the tray 50 as shown in FIG. 22. The process at step 174 disengages the vacuum pump 27, in turn releasing the suction in the vacuum mechanism 60. The linear actuator 24 then is retracted in step 176, returning the produce packing system 10 to the position depicted in FIG. 9. At step 178, a unit of one is added to the number of trays in the box count, and at step 179, the tray placement process ends. The process reverts back to step 110 in FIG. 8 where the next tray 50, in this embodiment, is already in process.

It should be noted that keeping the tray 50 from sagging using a vacuum, as explained above, allows the linear actuator 24 to lower the tray to the desired position without rubbing, bruising, smashing the apples on the tray 50 in the end effector 22 or the tray 50 below it in the box 64. It should be noted that typically the trays 50 used are normally ¼ to ½ in larger diameter than the inner dimensions of the box, making it difficult to properly place a tray 50 in the box 64 without bruising the produce. The produce packing system 10 of this invention overcomes this by accounting for this size differential when disengaging the end effector 22 to place the tray in the box 64.

Figure 23:
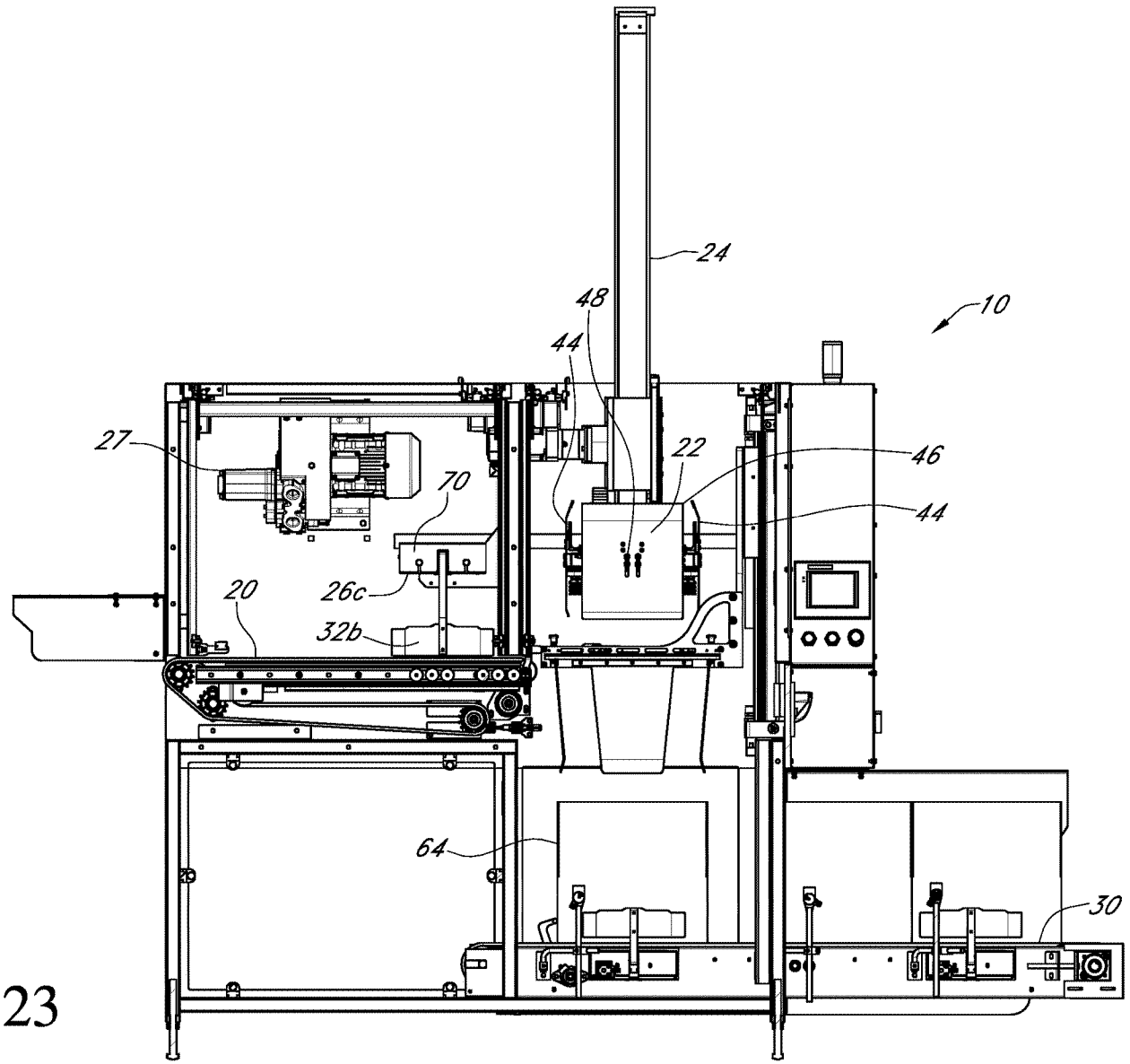
FIG. 23 is a side sectional view of another embodiment of the produce packing system of the present invention.
Figure 24:
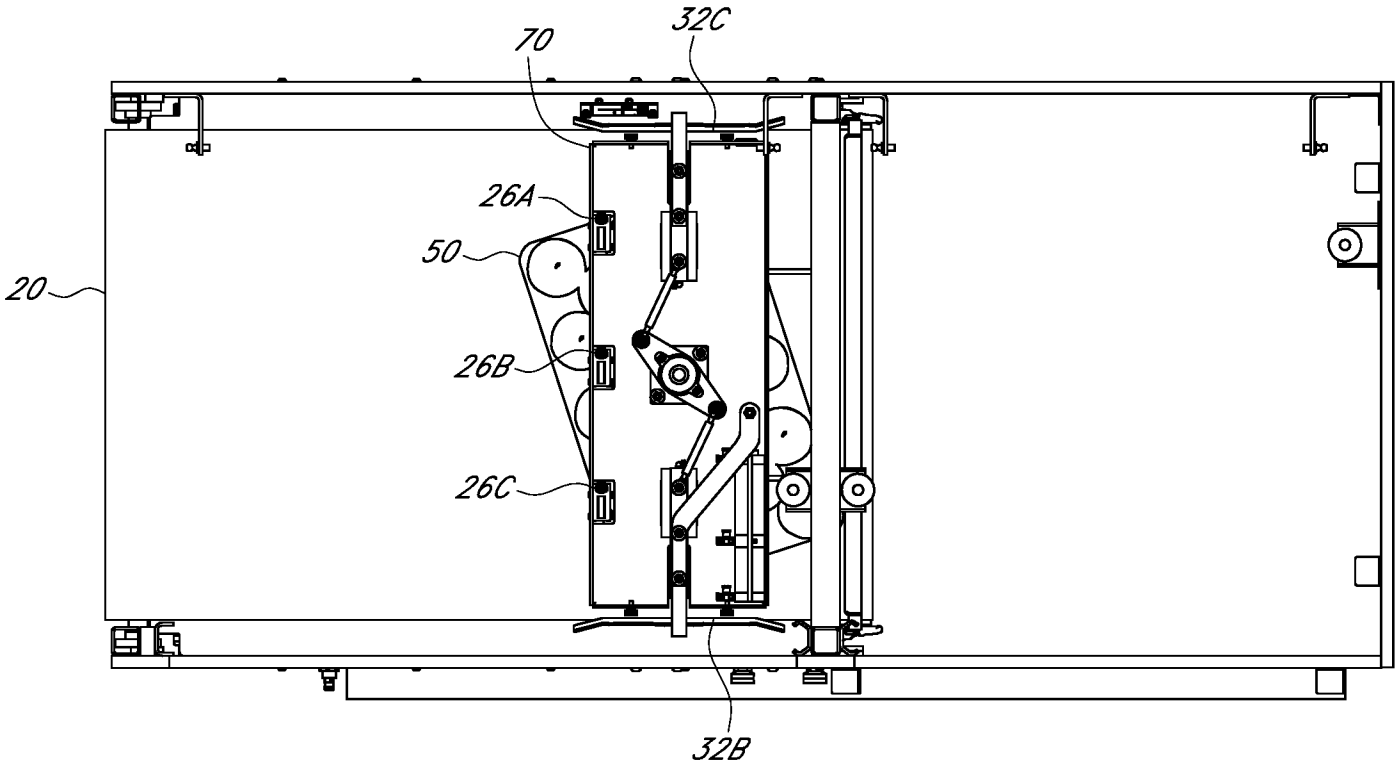
FIG. 24 is a top plan view depicting an alignment step in the process of another embodiment of the produce packing system of the present invention.
Figure 25:
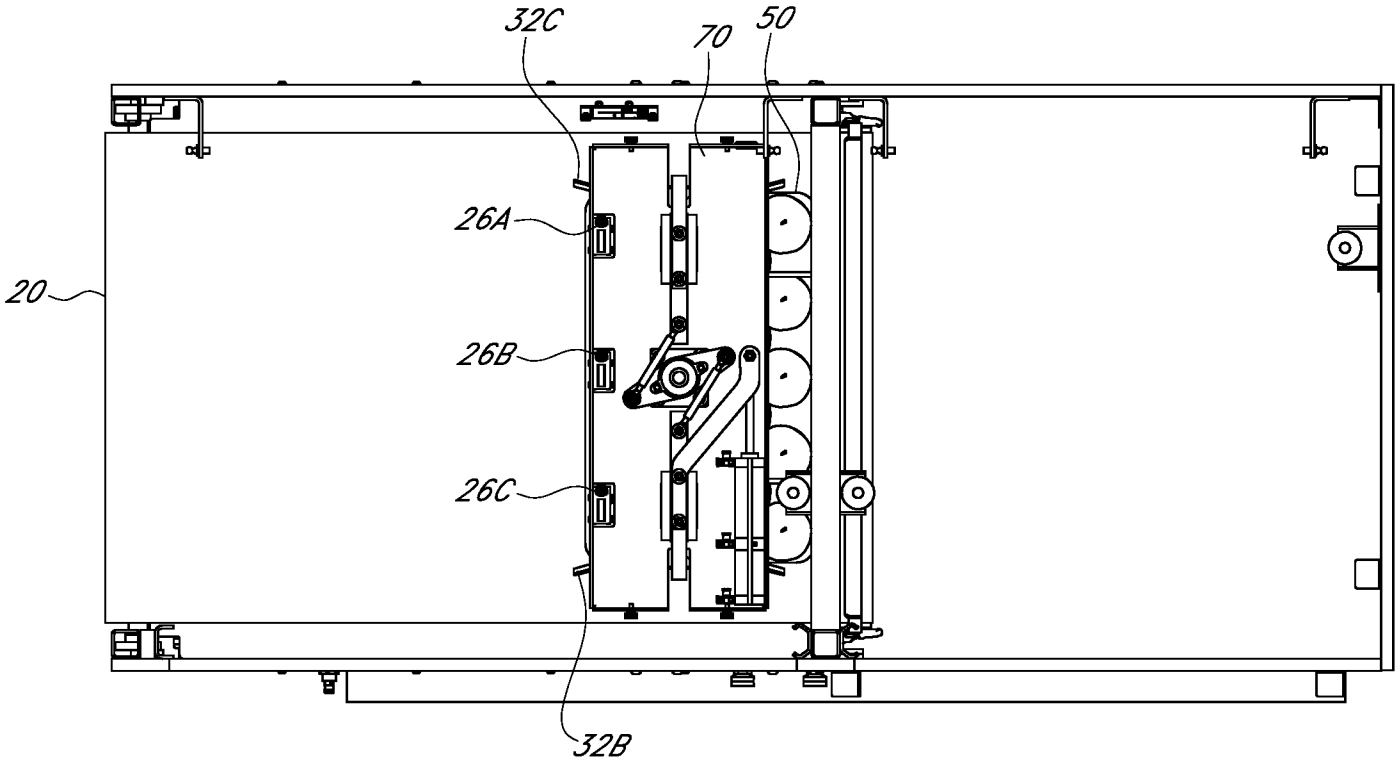
FIG. 25 is a top plan view depicting another alignment step in the process of another embodiment of the produce packing system of the present invention.

Referring now to FIGS. 23-25, another embodiment of the produce packing system 10 of the present invention is depicted. In this embodiment, instead of the process of product height detection (FIGS. 8, 10) and the tray adjustment (FIGS. 8, 12-13) happening at different stages of the advancement of the infeed belt 20, this embodiment includes an integrated unit 70 that integrates the produce information sensors 26*a*-26*c* and the justifiers 32*b*, 32*c* so that the produce packing system 10 can detect product height and align the tray 50 at the same time, with the infeed belt 20 in the retracted position. As such, in this embodiment, the tray 50 is aligned before being situated under the linear actuator assembly 24 and the end effector 22. This allows the tray 50 to be prepped and justified while the linear actuator assembly 24 is completing the cycle of placing the prior tray 50 into the box 64. By integrating the process of product height detection and the tray adjustment, the cycle time between the picking and placing of trays 50 in the box 64 is decreased, leading to faster operation of the produce packing system 10.

Although the process has been described based on the embodiments disclosed and explained above, it should be noted that this process may be altered without escaping the intended scope of the described process. A few examples are, the measurement sensor or sensors 26 may be accompanied by or replaced by a bar code scanner, infrared, laser, sonar or other technology to achieve the same distance or size sensing functionality. The actuators 44 may have more degrees of freedom than just vertical movement. The infeed belt 20 may be retractable or stationary. The justifiers 32 may be a different mechanical design, but still have the same extend and retract function to square the tray 50 under the end effector 22.

What is claimed is:

1. An apparatus for packing a plurality of open-top trays into a transport container, wherein each open-top tray contains individual pieces of produce, comprising:

at least one produce information sensor for measuring the height of each individual piece of produce for each open-top tray that passes under the at least one produce information sensor;

a processing assembly, in communication with the at least one produce information sensor, configured to receive measured height information from the at least one produce information sensor for each open-top tray that passes under the at least one produce information sensor, wherein the processing assembly uses the received measured height information for each open-top tray to calculate a container packing position height for a next open-top tray that is to be stacked on top of a presently measured open-top tray based on the highest piece of produce in the open-top tray and stores that calculated container packing position height for the processing assembly to use when stacking the next open-top tray;

a linear actuator assembly; and an end effector attached to an end of the linear actuator assembly; wherein, when activated:

the at least one produce information sensor measures the height of each individual piece of produce for a first open-top tray that passes under the at least one produce information sensor:

the processing assembly receives the measured height information from the at least one produce information sensor for the first open-top tray; uses the received measured height information for the first open-top tray to calculate a first container packing position height for a second open-top tray that is to be stacked next on top of the first open-top tray, wherein the first calculated container packing position height for the second open-top tray is based on the measurement of the highest piece of produce in the first open-top tray;

the processing assembly stores the first calculated container packing position height for the processing assembly to use when stacking the second open-top tray;

the processing assembly then activates the end effector to clamp onto the first open-top tray;

the processing assembly then activates the linear actuator assembly to move the first open-top tray into a transport container and unclamps the end effector from the first open-top tray to place the first open-top tray into the transport container;

the processing assembly retracts the linear actuator assembly to a pre-set position;

then, when a second open-top tray is detected, the at least one produce information sensor measures the height of each individual piece of produce for the second open-top tray that passes under the at least one produce information sensor:

the processing assembly receives the measured height information from the at least one produce information sensor for the second open-top tray; uses the received measured height information for the second open-top tray to calculate a second container packing position height for a third open-top tray that is to be stacked next on top of the second open-top tray, wherein the calculated container packing position height for the third open-top tray is based on the measurement of the highest piece of produce in the second open-top tray;

the processing assembly stores the second calculated container packing position height for the processing assembly to use when stacking the third open-top tray;

the processing assembly then activates the end effector to clamp onto the second open-top tray;

the processing assembly then activates the linear actuator assembly to move the second open-top tray into the transport container; stops the linear actuator assembly in the transport container at the stored first calculated container packing position height, and unclamps the end effector from the second open-top tray to place the second open-top tray into the transport container without bruising, or at least minimizing bruising to, the individual pieces of produce in the first open-top tray already in the transport container; and the processing assembly continues to place open-top trays into the transport container using a calculated container packing position height from the open-top tray placed into the transport container just prior to the present open-top tray being placed until all of the open-top trays presented to the at least one produce information sensor are packed into the transport container.

2. The apparatus for packing a plurality of open-top trays into a transport container of claim 1, wherein the at least one produce information sensor comprises a plurality of produce information sensors.

3. The apparatus for packing a plurality of open-top trays into a transport container of claim 2, wherein the plurality of produce information sensors measure the height of each individual piece of produce for each tray that passes under the plurality of produce information sensors.

4. The apparatus for packing a plurality of open-top trays into a transport container of claim 3, wherein the processing assembly calculates a container packing position from the measured height information that the processing assembly receives from the plurality of produce information sensors.

5. The apparatus for packing a plurality of open-top trays into a transport container of claim 1, further comprising a retractable infeed belt.

6. The apparatus for packing a plurality of open-top trays into a transport container of claim 5, further comprising a plurality of tray location sensors.

7. The apparatus for packing a plurality of open-top trays into a transport container of claim 1, further comprising a plurality of justifiers.

8. The apparatus for packing a plurality of open-top trays into a transport container of claim 1, wherein the at least one produce information sensor and the plurality of justifiers are integrated in a common assembly.

9. The apparatus for packing a plurality of open-top trays into a transport container of claim 1, wherein the end effector includes a vacuum mechanism for engaging an open-top tray.

10. An apparatus for packing a plurality of open-top trays into a transport container, wherein each open-top tray contains individual pieces of produce, comprising:

an infeed belt;

at least one produce information sensor for measuring the height of each individual piece of produce for each open-top tray that passes under the at least one produce information sensor;

a processing assembly, in communication with the at least one produce information sensor, configured to receive measured height information from the at least one produce information sensor for each open-top tray that passes under the at least one produce information sensor, wherein the processing assembly uses the received measured height information for each open-top tray to calculate a container packing position height for a next open-top tray that is to be stacked on top of a presently measured open-top tray based on the highest piece of produce in the open-top tray and stores that calculated container packing position height for the processing assembly to use when stacking the next open-top tray;

a linear actuator assembly; and an end effector attached to an end of the linear actuator assembly having a vacuum mechanism; wherein, when activated:

the infeed belt feeds a first open-top tray to the at least one produce information sensor;

the at least one produce information sensor measures the height of each individual piece of produce for the first open-top tray that passes under the at least one produce information sensor:

the processing assembly receives the measured height information from the at least one produce information sensor for the first open-top tray; uses the received measured height information for the first open-top tray to calculate a first container packing position height for a second open-top tray that is to be stacked next on top of the first open-top tray, wherein the first calculated container packing position height for the second open-top tray is based on the measurement of the highest piece of produce in the first open-top tray;

the processing assembly stores the first calculated container packing position height for the processing assembly to use when stacking the second open-top tray;

the processing assembly then activates the end effector to clamp onto and provide suction to the first open-top tray fed to the end effector by the infeed belt;

the processing assembly then activates the linear actuator assembly to move the first open-top tray into a transport container and unclamps the end effector from the first open-top tray and deactivates the suction to place the first open-top tray into the transport container;

the processing assembly retracts the linear actuator assembly to a pre-set position;

then, the infeed belt feeds a second open-top tray to the at least one produce information sensor;

the at least one produce information sensor measures the height of each individual piece of produce for the second open-top tray that passes under the at least one produce information sensor:

the processing assembly receives the measured height information from the at least one produce information sensor for the second open-top tray; uses the received measured height information for the second open-top tray to calculate a second container packing position height for a third tray that is to be stacked next on top of the second open-top tray, wherein the calculated container packing position height for the third open-top tray is based on the measurement of the highest piece of produce in the second open-top tray;

the processing assembly stores the second calculated container packing position height for the processing assembly to use when stacking the third open-top tray;

the processing assembly then activates the end effector to clamp onto and provide suction to the second open-top tray fed to the end effector by the infeed belt;

the processing assembly then activates the linear actuator assembly to move the second open-top tray into the transport container; stops the linear actuator assembly in the transport container at the stored first calculated container packing position height, and deactivates the suction and unclamps the end effector from the second open-top tray to place the second open-top tray into the transport container without bruising, or at least minimizing bruising to, the individual pieces of produce in the first open-top tray already in the transport container; and the processing assembly continues to place open-top trays into the transport container using a calculated container packing position height from the tray placed into the transport container just prior to the present open-top tray being placed until all of the open-top trays presented to the at least one produce information sensor are packed into the transport container.

11. The apparatus for packing a plurality of open-top trays into a transport container of claim 10, wherein the at least one produce information sensor comprises a plurality of produce information sensors.

12. The apparatus for packing a plurality of open-top trays into a transport container of claim 11, wherein the plurality of produce information sensors measure the height of each individual piece of produce for each tray that passes under the plurality of produce information sensors.

13. The apparatus for packing a plurality of open-top trays into a transport container of claim 12, wherein the processing assembly calculates a container packing position from the measured height information that the processing assembly receives from the plurality of produce information sensors.

14. The apparatus for packing a plurality of open-top trays into a transport container of claim 10, wherein the infeed belt is retractable.

15. The apparatus for packing a plurality of open-top trays into a transport container of claim 14, further comprising a plurality of tray location sensors.

16. The apparatus for packing a plurality of open-top trays into a transport container of claim 10, further comprising a plurality of justifiers.

17. The apparatus for packing a plurality of open-top trays into a transport container of claim 10, wherein the at least one produce information sensor and the plurality of justifiers are integrated in a common assembly.

18. An apparatus for packing a plurality of open-top trays into a transport container, wherein each open-top tray contains individual pieces of produce, comprising:

an infeed belt;

at least one produce information sensor for measuring the height of each individual piece of produce for each open-top tray that passes under the at least one produce information sensor;

a processing assembly, in communication with the at least one produce information sensor, configured to receive measured height information from the at least one produce information sensor for each open-top tray that passes under the at least one produce information sensor, wherein the processing assembly uses the received measured height information for each open-top tray to calculate a container packing position height for a next open-top tray that is to be stacked on top of a presently measured open-top tray based on the highest piece of produce in the open-top tray and stores that calculated container packing position height for the processing assembly to use when stacking the next open-top tray;

a linear actuator assembly; and an end effector attached to an end of the linear actuator assembly having a vacuum mechanism, a plurality of actuators, and a plurality of clamp plates connected to the plurality of actuators; wherein, when activated:

the infeed belt feeds a first open-top tray to the at least one produce information sensor;

the at least one produce information sensor measures the height of each individual piece of produce for the first open-top tray that passes under the at least one produce information sensor:

the processing assembly receives the measured height information from the at least one produce information sensor for the first open-top tray; uses the received measured height information for the first open-top tray to calculate a first container packing position height for a second open-top tray that is to be stacked next on top of the first open-top tray, wherein the first calculated container packing position height for the second open-top tray is based on the measurement of the highest piece of produce in the first open-top tray;

the processing assembly stores the first calculated container packing position height for the processing assembly to use when stacking the second open-top tray;

the processing assembly then activates the end effector to clamp onto and provide suction to the first open-top tray fed to the end effector by the infeed belt;

the processing assembly then activates the linear actuator assembly to move the first open-top tray into a transport container and unclamps the end effector from the first open-top tray and deactivates the suction to place the first open-top tray into the transport container;

the processing assembly retracts the linear actuator assembly to a pre-set position;

then, the infeed belt feeds a second open-top tray to the at least one produce information sensor;

the at least one produce information sensor measures the height of each individual piece of produce for the second open-top tray that passes under the at least one produce information sensor:

the processing assembly receives the measured height information from the at least one produce information sensor for the second open-top tray; uses the received measured height information for the second open-top tray to calculate a second container packing position height for a third tray that is to be stacked next on top of the second open-top tray, wherein the calculated container packing position height for the third open-top tray is based on the measurement of the highest piece of produce in the second open-top tray;

the processing assembly stores the second calculated container packing position height for the processing assembly to use when stacking the third open-top tray;

the processing assembly then activates the end effector to clamp onto and provide suction to the second open-top tray fed to the end effector by the infeed belt;

the processing assembly then activates the linear actuator assembly to move the second open-top tray into the transport container; stops the linear actuator assembly in the transport container at the stored first calculated container packing position height, and deactivates the suction and unclamps the end effector from the second open-top tray to place the second open-top tray into the transport container without bruising, or at least minimizing bruising to, the individual pieces of produce in the first open-top tray already in the transport container; and the processing assembly continues to place open-top trays into the transport container using a calculated container packing position height from the tray placed into the transport container just prior to the present open-top tray being placed until all of the open-top trays presented to the at least one produce information sensor are packed into the transport container.

19. The apparatus for packing a plurality of open-top trays into a transport container of claim 18, wherein the at least one produce information sensor comprises a plurality of produce information sensors.

20. The apparatus for packing a plurality of open-top trays into a transport container of claim 18, further comprising a plurality of tray location sensors.

* * * * *